US010426683B2

(12) United States Patent
Hillenbrand, II et al.

(10) Patent No.: US 10,426,683 B2
(45) Date of Patent: Oct. 1, 2019

(54) PATIENT REPOSITIONING SYSTEM FOR BARIATRIC BED

(71) Applicant: Hillenbrand Management Company LLC, Batesville, IN (US)

(72) Inventors: William Hillenbrand, II, Batesville, IN (US); Joseph Kummer, Cincinnati, OH (US); David Hornback, Brookville, IN (US)

(73) Assignee: Hillenbrand Management Company LLC, Batesville, IN (US)

( * ) Notice: Subject to any disclaimer, the term of this patent is extended or adjusted under 35 U.S.C. 154(b) by 126 days.

(21) Appl. No.: 15/502,115

(22) PCT Filed: Aug. 4, 2015

(86) PCT No.: PCT/US2015/043618
§ 371 (c)(1),
(2) Date: Feb. 6, 2017

(87) PCT Pub. No.: WO2016/022564
PCT Pub. Date: Feb. 11, 2016

(65) Prior Publication Data

US 2017/0231847 A1 Aug. 17, 2017

Related U.S. Application Data

(60) Provisional application No. 62/032,861, filed on Aug. 4, 2014.

(51) Int. Cl.
*A61G 7/10* (2006.01)
*A61G 7/05* (2006.01)

(52) U.S. Cl.
CPC ..... *A61G 7/1026* (2013.01); *A61G 7/0512* (2016.11); *A61G 7/0525* (2013.01); *A61G 2200/16* (2013.01)

(58) Field of Classification Search
CPC ..... A61G 7/10
(Continued)

(56) References Cited

U.S. PATENT DOCUMENTS 4,926,513 A * 5/1990 Oats ..... A47C 21/028 5/488
6,357,065 B1 3/2002 Adams
(Continued)

OTHER PUBLICATIONS

ISA/US, International Search Report and Written Opinion, dated Sep. 29, 2015.

*Primary Examiner* — Fredrick C Conley
(74) *Attorney, Agent, or Firm* — Wood Herron & Evans LLP

(57) ABSTRACT

A patient repositioning system (10) for a bariatric bed (12) includes a mattress (14) having a head end (54), a foot end (52), and an upper surface (46), a sheet (16) residing on the upper surface (46), a drive mechanism (22) operatively coupled to the sheet (16) and adapted to pull the sheet (16) toward the head end (54), and a housing (20) which holds the drive mechanism (22). The mattress (14) further includes a body portion (114) and at least one operatively coupled attached side bolster (112*a*) located along one longitudinal side (62*a*) of the body portion (114), thereby to widen the upper surface (46) of the mattress (14) so as to accommodate standard bariatric dimensions. Alternatively, instead of a side bolster (112*a*), the invention contemplates the use of transition pieces (136*a*, 136*b*) near the head end (54), a rotatable housing (20), or a telescopically expandable/contractable housing (20), thereby to expand to accommodate bariatric dimensions and contract to reduced dimensions so as to fit through a standard size doorway.

17 Claims, 20 Drawing Sheets

(58) Field of Classification Search
USPC ..... 5/81.1 HS, 81.1 C, 81.1 RP, 81.1 R
See application file for complete search history.

(56) References Cited

U.S. PATENT DOCUMENTS

| | | | | |
|---|---|---|---|---|
| 7,225,489 | B1 * | 6/2007 | Frickey ..... | A47C 19/04 5/690 |
| 7,805,782 | B2 | 10/2010 | Hakamium et al. | |
| 8,584,288 | B2 | 11/2013 | Shaw | |
| 2010/0281613 | A1 | 11/2010 | Hillenbrand, II | |
| 2012/0144581 | A1 | 6/2012 | Roberg | |

* cited by examiner

PATIENT REPOSITIONING SYSTEM FOR BARIATRIC BED

CROSS-REFERENCE TO RELATED APPLICATIONS

This application claims priority, under Section 371 and/or as a continuation under Section 120, to PCT Application No. PCT/US2015/043618, fled on Aug. 4, 2015 ("the PCT '618 application"). Also, the PCT '618 application claims priority to U.S. Provisional Patent Application No. 62/032,861, entitled "Patient Repositioning System for Bariatric Bed," filed on Aug. 4, 2014, which is expressly incorporated by reference herein in its entirety.

FIELD OF THE INVENTION

The present invention relates to patient repositioning, and more particularly, to a system for repositioning a patient by moving the patient toward a head end of a bariatric bed.

SUMMARY OF THE DISCLOSURE

Since at least the 1950's, it has been recognized that a person supported on an articulating bed, such as a hospital bed or other type of conventional health care bed, tends to migrate from the head end of the bed toward the foot end of the bed when the head end of the bed is raised. For example, the force of gravity and a patient's movement in bed often causes this migration. Generally, this problem has been addressed by moving the patient back toward the head end of the bed, either by manually lifting and pulling the patient or by using a lifting device to move the patient. The problems associated with manually pulling the patient are well recognized, and include potential injury to the puller, i.e., the caregiver(s), often one or more nurses. Applicant has solved this general problem, via the inventions disclosed in applicant's currently pending U.S. patent application Ser. No. 13/837,185, filed Mar. 15, 2013, entitled "Patient Repositioning System" ("the '185 application") and U.S. patent application Ser. No. 14/480,170, filed Sep. 8, 2014, entitled "Sheet Receiver for Patient Repositioning System" ("the '170 application") each of which is expressly incorporated by reference herein, in its entirety.

Nonetheless, the problems associated with patient adjustment may be amplified in the case of an obese patient, who may require a larger bed, specifically a "bariatric bed", i.e. a bed of relatively greater width, such as 48 inches. Moreover, the need to adjust the position of an obese patient can also present added concerns about the dignity of the patient. Bariatric beds are generally known in the industry, as demonstrated by, for example, U.S. Pat. Nos. 7,464,425; 7,805,782; and 7,827,632, each of which is expressly incorporated by reference herein, in its entirety.

Applicant's presently pending '185 application shows and describes various details and embodiments of a patient repositioning system wherein the system moves a sheet and the patient supported thereon toward a head end of the bed (such as a healthcare bed) that articulates to improve patient comfort. Such a system is safe, practical, robust, and user-friendly compared to prior art devices for patient repositioning. The '185 application discloses numerous features and details related to the general concept of patient repositioning in this manner.

Generally, a patient repositioning system of the type shown and described in the '185 application relies on the cooperative interaction of three main components, namely, a mattress, a sheet, and a sheet receiver for pulling a sheet toward a head end of the mattress, with the sheet receiver encompassing a housing and a drive mechanism. In general, the specification of the '185 application recognizes the potential adaptability for use in combination with other types of beds, such as a "step deck" bed, a birthing bed, or a bariatric bed. More specifically, according to the '185 application, for those variations of the general invention as disclosed therein, the mattress and the housing may be reoriented and/or reconfigured to accommodate different bed shapes, and particularly the different shapes of the bed deck and/or the mattress. The present invention expands the capability of the structure shown and described in the '185 application, so as to specifically accommodate a bariatric bed with an expanded width, for example, a width of 48 inches. Moreover, the specific features disclosed and described herein were not contemplated by the '185 application.

One approach to accommodating such a bed would be to similarly expand the widthwise dimension of the sheet receiver shown and described in the '185 and '170 applications, so that the sheet receiver, the outer contours of which are defined by the housing, has a widthwise dimension which matches that of the width of the bed, or in this instance, 48 inches. Although this option would be acceptable for accommodating some situations, this option would not be practical in situations where the bed needs to be moved through a standard size doorway. Given that the width of a standard size doorway is smaller than 48 inches, i.e. typically 42 inches, there is a need to accommodate bariatric beds which are able to be moved through a standard size 42 inch wide doorway.

It should be understood by those skilled in the art that the phrase "widthwise dimension" when used in reference to the sheet receiver refers to the dimension that corresponds to the width of the bed, and also the mattress. In other words, the widthwise dimension of the sheet receiver is the dimension from one side of the bed to the other side. Those skilled in the art will also appreciate that when the sheet receiver is considered as a separate unit, the widthwise dimension actually represents the overall length of the sheet receiver itself.

By way of example, the below scenarios may be completed by the patient repositioning system disclosed in the '185 application and the '170 application in conjunction with the patient repositioning system as described herein.

According to one exemplary embodiment of the present application, a patient repositioning system for a bariatric bed includes a mattress including one or more side bolsters, a sheet, a drive mechanism and a housing holding the drive mechanism. The mattress includes a head end and a foot end and an upper surface, with a sheet residing on the upper surface of the mattress. The drive mechanism is operatively coupled to the sheet and adapted to pull the sheet toward the head end. The mattress further includes a body portion and at least one operatively coupled attached side bolster located along at least one longitudinal side of the body portion to widen the upper surface of the mattress.

Furthermore, the mattress body portion may include at least one row of one or more retainers substantially covered by the operatively coupled side bolster. The operatively coupled side bolster preferably includes at least one row of discretely spaced retainers adapted to retain a corresponding edge of the sheet. The side bolsters may also include voids on a vertically oriented inner surface which abuts up against the mattress body portion, wherein the voids accommodate a like number of retainers on the corresponding surface of the mattress body portion. This arrangement of the voids with respect to the retainers of the regular size mattress may be helpful in registering and aligning the side bolsters in proper position. The operatively coupled side bolster may also include a firmer head end section to limit the compressibility of the bolster and to guide the sheet into the drive mechanism. The patient repositioning system may also include a user interface operatively coupled to the drive mechanism which permits control of the drive mechanism when the bolster is in place.

According to another exemplary embodiment of the invention, a patient repositioning system includes a mattress, a sheet, a drive mechanism, and a rotatable housing holding the drive mechanism. The mattress includes a head end and a foot end and an upper surface, with a sheet residing on the upper surface of the mattress. The drive mechanism is operatively coupled to the sheet and adapted to pull the sheet toward the head end, and a housing holding the drive mechanism, where the housing has a widthwise dimension that is substantially the same as the width of a bariatric bed frame and is rotatable with respect to a vertical axis. Furthermore, the length of the housing may be greater than 36 inches.

According to yet another exemplary embodiment of the invention, a patient repositioning system includes a mattress, a sheet, a drive mechanism, and an expandable housing holding the drive mechanism. The mattress includes a head end and a foot end and an upper surface to accommodate the sheet. A drive mechanism is operatively coupled to the sheet and adapted to pull the sheet toward the head end. The housing expands/contracts in length to match the widthwise dimension of the mattress and/or the bed frame.

Furthermore, the housing may include at least one vertical sidewall that slides outwardly to expand and contract the housing when deployed/moved. The expandable housing may positively lock in place when deployed to a desired dimension. Additionally, the housing may include slideable sections with overlapping surfaces that permit the housing to be telescopically expanded and contracted without exposing the internal volume of the housing. Additionally, the drive mechanism may include slideable pieces with overlapping surfaces that permit the drive mechanism to be telescopically expanded and contracted. The slideable sections and the slideable pieces may positively lock in place when deployed. The bed may further include a mechanism to widen and narrow the upper surface of the bed. This mechanism may expand and contract the widthwise dimension of the housing and/or the drive mechanism.

According to still yet another exemplary embodiment of the invention, a patient repositioning system includes a mattress having a head end and a foot end and an upper surface, a sheet residing on the upper surface, a drive mechanism, a housing holding the drive mechanism, and a pair of transition pieces. The drive mechanism, operatively coupled to the sheet and adapted to pull the sheet toward the head end, has a width dimension less than the width of the mattress. Furthermore, the pair of transition pieces are located on the head end of the mattress on opposite sides of the housing, to facilitate pulling the sheet into the housing during operation. For example, the transition pieces may be a pair of pivoting ledges which hold a pair of mattress sections or a pair of wings.

Various additional objectives, advantages, and features of the invention will be appreciated from a review of the following detailed description of the illustrative embodiments taken in conjunction with the accompanying drawings.

DETAILED DESCRIPTION OF THE DRAWINGS

The initial part of this detailed description relates to the general concepts of a patient repositioning system 10, as shown in FIGS. 1A, 1B, 1C, 2, and 3. Thereafter, this detailed description describes the various alternate embodiments that are applicable to a bariatric bed 12.

Figure 1A:
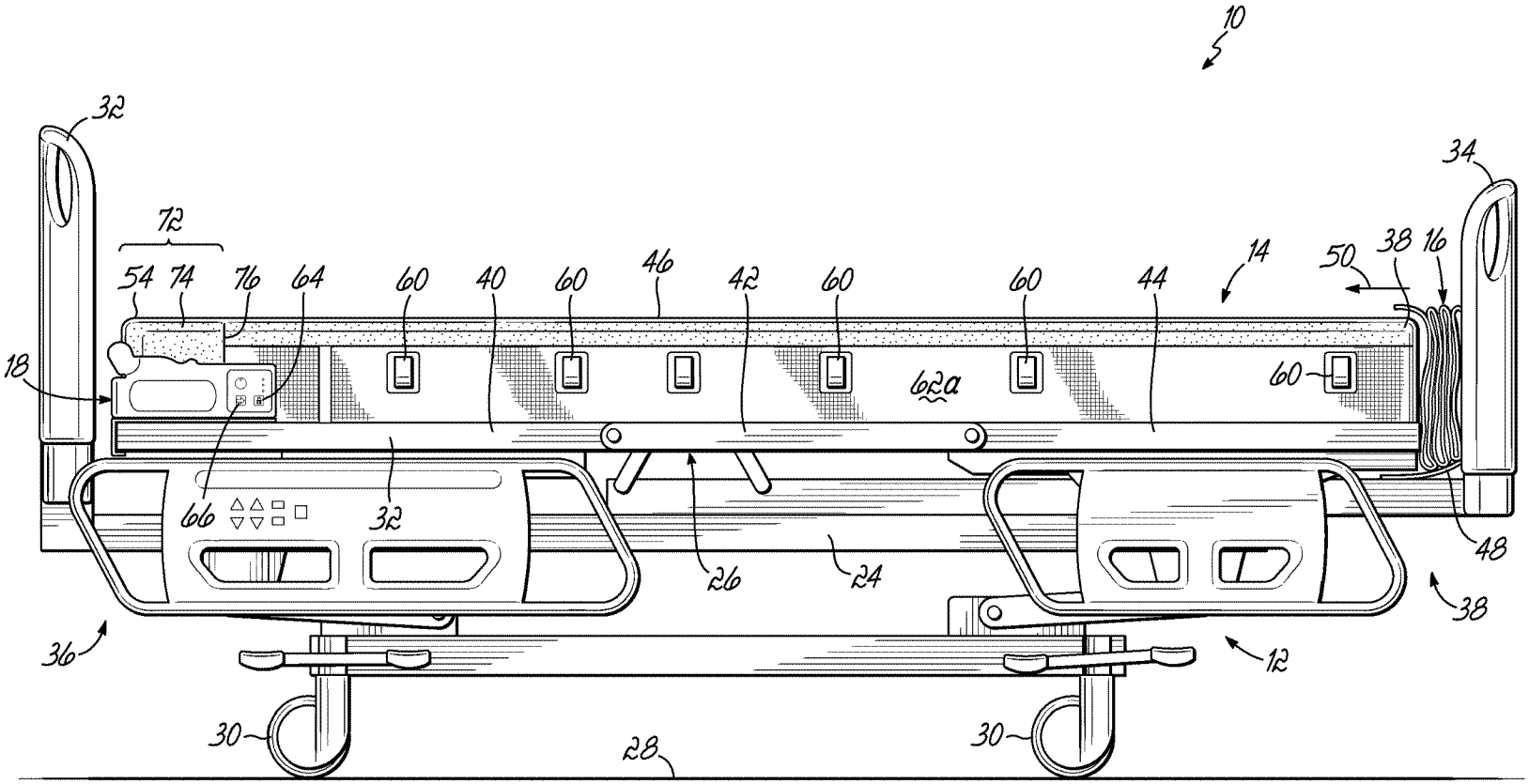
FIG. 1A is a side view of a patient repositioning system for use with a bariatric bed.

With reference to FIG. 1A, an embodiment of a patient repositioning system 10 for use with a bariatric bed 12 includes a mattress 14, a sheet 16, and a sheet receiver 18. The sheet receiver 18 generally encompasses a housing 20 and a drive mechanism 22 (see FIGS. 2 and 3). The exemplary bariatric bed 12 is more particularly an articulating bariatric bed 12 commonly used in hospitals, nursing homes, private homes, or any other environment where patient care is enhanced through the use of a bariatric bed 12 that articulates. Common articulating beds include a bed frame 24 for supporting a bed deck 26 above a floor 28. The bariatric bed frame 24 also includes a plurality of wheels 30 to more easily move the bariatric bed 12 in preparation of or during patient care. The bariatric bed 12 also includes a headboard 32 and footboard 34 each removably attached to a respective head end 36 and foot end 38 of the bariatric bed 12. With respect to the use of the terms "head" or "head end" and "foot" or "foot end," it will be appreciated that such directions are intended to describe relative locations along exemplary embodiments of the patient repositioning system 10 positioned along the bariatric bed 12.

The sheet receiver 18, mattress 14, and sheet 16 are each positioned adjacent to the bed deck 26 as shown in FIG. 1A. More particularly, the bed deck 26 includes a head deck portion 40, a central deck portion 42, and a foot deck portion 44. Each of the head deck portion 40, the central deck portion 42, and the foot deck portion 44 are pivotably connected together for use as the articulating bariatric bed 12. The mattress 14 rests directly upon the bed deck 26 similar to a traditional mattress. However, unlike a traditional mattress, the sheet receiver 18 is secured to the head deck portion 40 below a portion of the mattress 14, while the sheet 16 may be partially stowed between the mattress 14 and the footboard 34. FIG. 1A shows the sheet receiver 18 entirely below the upper mattress surface 46 of the mattress 14. But in the context of this specification "below" means that the sheet receiver 18 is at least in part below the upper mattress surface 46. The sheet receiver 18 also preferably releasably attaches to the mattress 14 for reducing the likelihood of inadvertent relative movement therebetween. For example, the sheet receiver 18 may attach to the mattress 14 via cooperating structures such as hook and loop fasteners, snaps, magnets or any other structure for releasably attaching one surface to another. A barrier 48 may also attach to the bariatric bed frame 24 below the foot deck portion 44 and extends toward the footboard 34. Accordingly, the barrier 48 supports at least a portion of the sheet 16 resting between the mattress 14 and the footboard 34.

As indicated by arrow 50 in FIG. 1A, the sheet 16 is pulled across an upper mattress surface 46 from a mattress foot end 52 toward a mattress head end 54, and the sheet 16 then is pulled into the sheet receiver 18. More particularly with respect to FIG. 1B, a beaded edge 56 on a sheet longitudinal side 58 is slidably positioned within a row of retainers 60. The row of retainers 60 is located along a mattress longitudinal side 62*a* for guiding the sheet 16 between the mattress foot end 52 and the mattress head end 54. The retainers 60, described further below, may be spaced along the mattress 14 in generally any orientation that both holds the sheet 16 and allows for operator access to the retainers 60 around various components of the bariatric bed 12. The sheet 16 is similarly received by another row of retainers 60 (not shown) on an opposing mattress longitudinal side 62*b* (see FIGS. 5A and 5B).

Figure 1B:
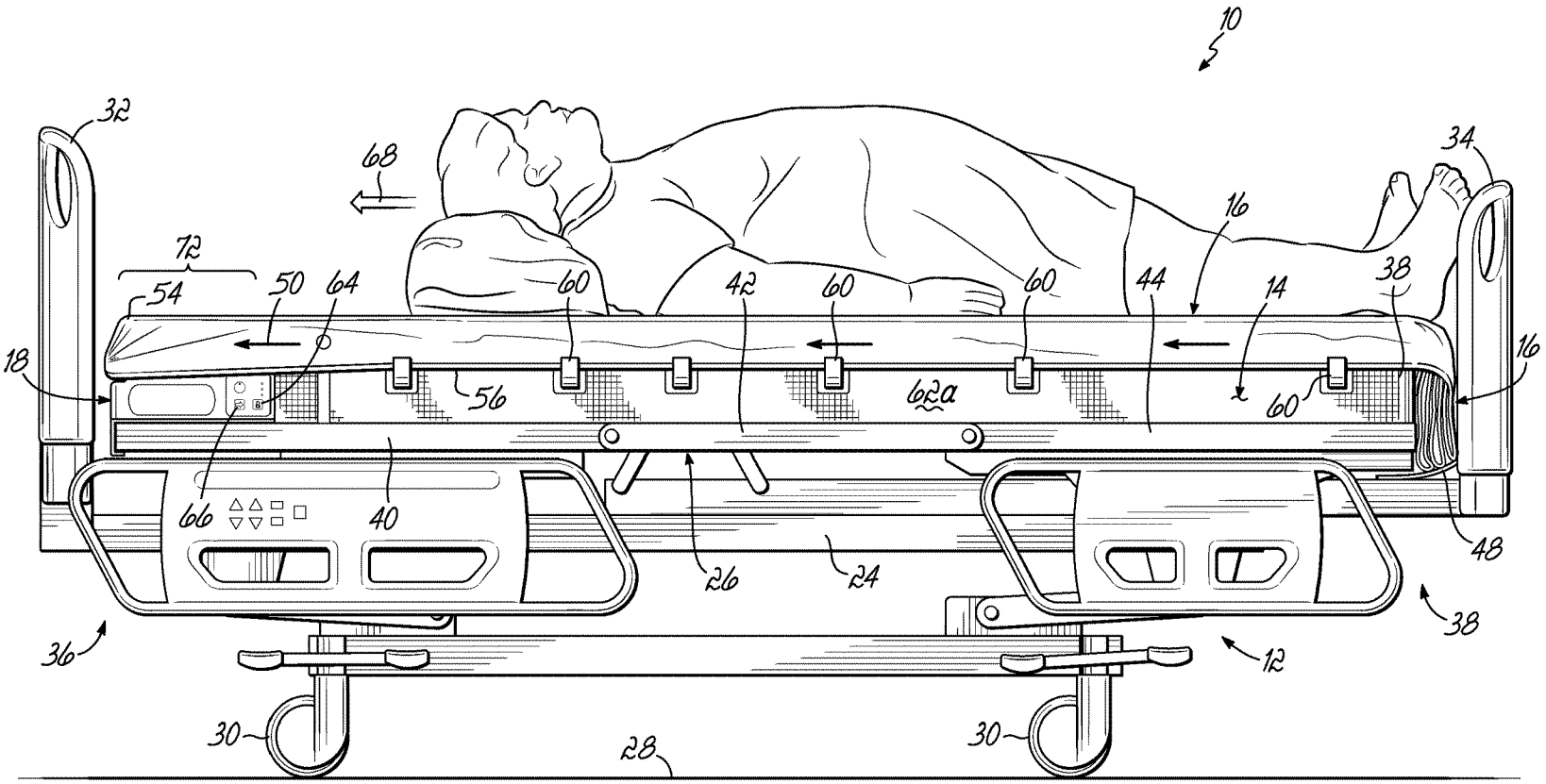
FIG. 1B is the side view of the patient repositioning system shown in FIG. 1A, with a patient residing on the bariatric bed near the foot end.

A patient is shown in FIG. 1B resting on the sheet 16 in a foot end position after having migrated from a head end position. Generally, the term "head end position" refers to a preferred patient position closer to the mattress head end 54 than the mattress foot end 52. Similarly, the term "foot end position" generally refers to any position of the patient after migrating from the mattress head end 54 toward the mattress foot end 52. It should be appreciated that the terms head end position and foot end position are merely exemplary and intended to show distinguishing positions in which to move the patient.

Figure 1C:
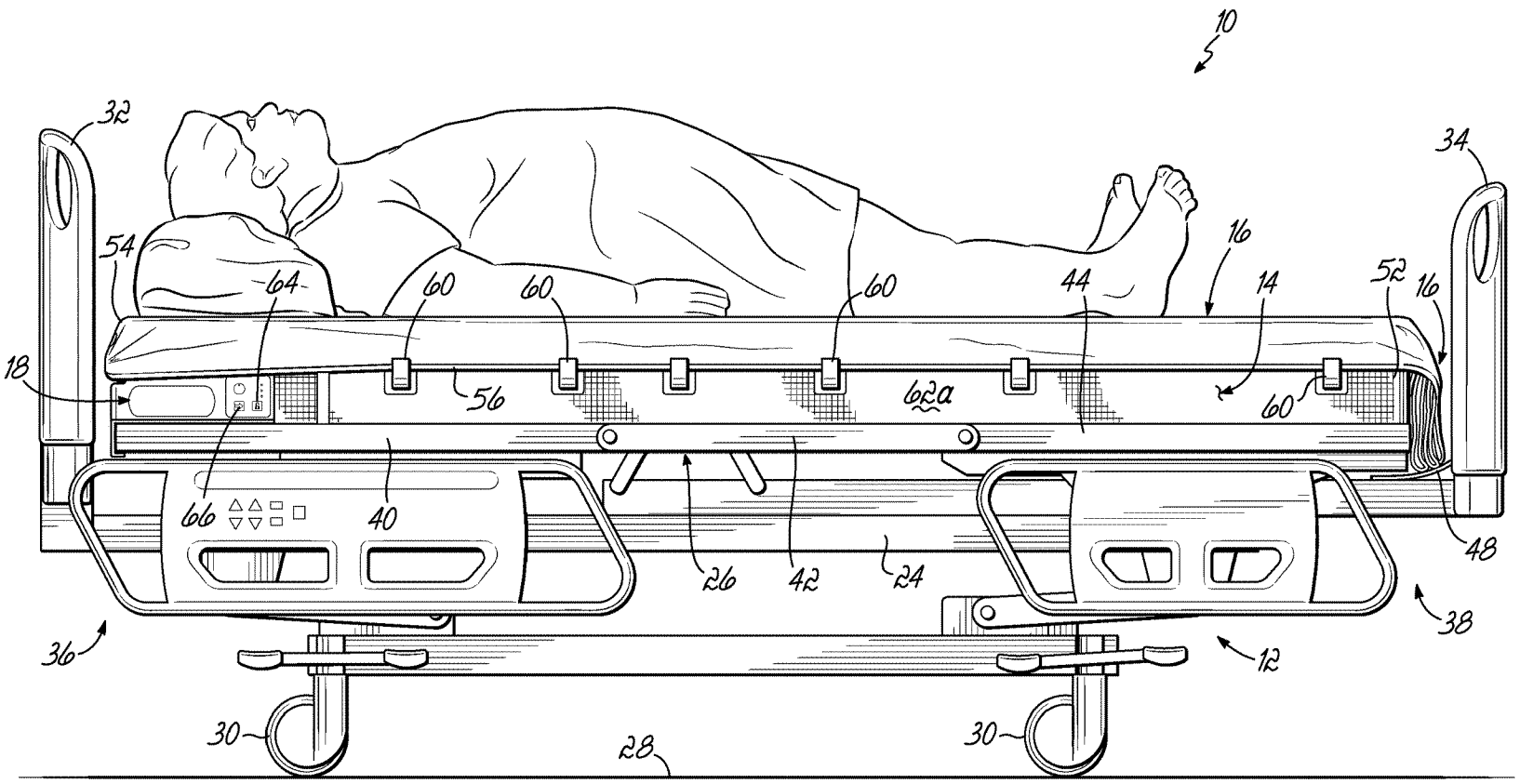
FIG. 1C is the side view of the patient repositioning system shown in FIG. 1B, but with the patient residing on the bariatric bed near the head end.

An operator, such as a caregiver or an attendant, may desire to return the patient to the head end position. In the past, moving the patient from the foot end position to the head end position has required manually gripping and pulling a sheet, on which the patient rests, toward the head end 36. However, the patient repositioning system 10 repositions the patient to the head end position under the direction of the operator. According to the exemplary embodiment, the operator enables the patient repositioning system 10 by activating an enabling switch 64 operatively connected to the sheet receiver 18. Once enabled, the operator then activates a drive switch 66 operatively connected to the sheet receiver 18. With both the enabling switch 64 and the drive switch 66 activated, the sheet receiver 18 pulls the sheet 16 along the upper mattress surface 46 toward the headboard 32, as indicated by arrow 68. Because the patient is resting on the sheet 16 as it moves, the patient similarly moves away from the footboard 34 and toward the headboard 32, as indicated by arrow 68. The patient is moved toward the headboard 32 until the patient reaches the desired head end position, as shown in FIG. 1C. Of course, in the event that the patient again migrates toward the foot end position, the operator may repeat the operation of repositioning the patient with the patient repositioning system 10 as desired.

With respect to FIGS. 1A-1C, the mattress 14 for repositioning the patient generally includes the mattress foot end 52, the mattress head end 54, the upper mattress surface 46, and the pair of longitudinal sides 62*a*, 62*b* as described above. Generally, the pair of longitudinal sides 62*a*, 62*b* is symmetric with a generally uniform thickness, while the upper mattress surface 46 has a substantially uniform width and length. The mattress 14 is also covered in an outer ticking 70 for effectively improving the life and comfort of the mattress 14. In addition, each of the retainers 60 is attached to the outer ticking 70 of the mattress 14 in spaced relation along the length of the opposing longitudinal sides 62*a*, 62*b* of the mattress 14. However, the mattress head end 54 also includes a head end section 72 of reduced thickness relative to the generally uniform thickness of the remaining mattress 14. In this respect, the head end section 72 is a relatively thin portion of the mattress 14 and further includes a head end piece 74. The head end piece 74 folds about a fold line 76 relative to the rest of the mattress 14 for improving access to the sheet receiver 18 below the upper mattress surface 46 of the mattress head end 54. However, it will be appreciated that other respective portions of the mattress 14 may be otherwise movable for accessing the sheet receiver 18.

Furthermore, at least a portion of the sheet receiver 18 is positioned within a volume envelope 78 (as shown in FIG. 4) of the mattress 14 to effectively reduce the overall footprint of the mattress 14 and sheet receiver 18. The reduced thickness of the head end section 72 has a lower surface 80 and a forward surface 82 that collectively define the volume envelope 78 that would otherwise be occupied by the mattress 14 if not for the head end section 72 of reduced thickness. Stated alternatively, the head end section 72 is complementary in shape to a housing 20 of the sheet receiver 18.

Figure 2:
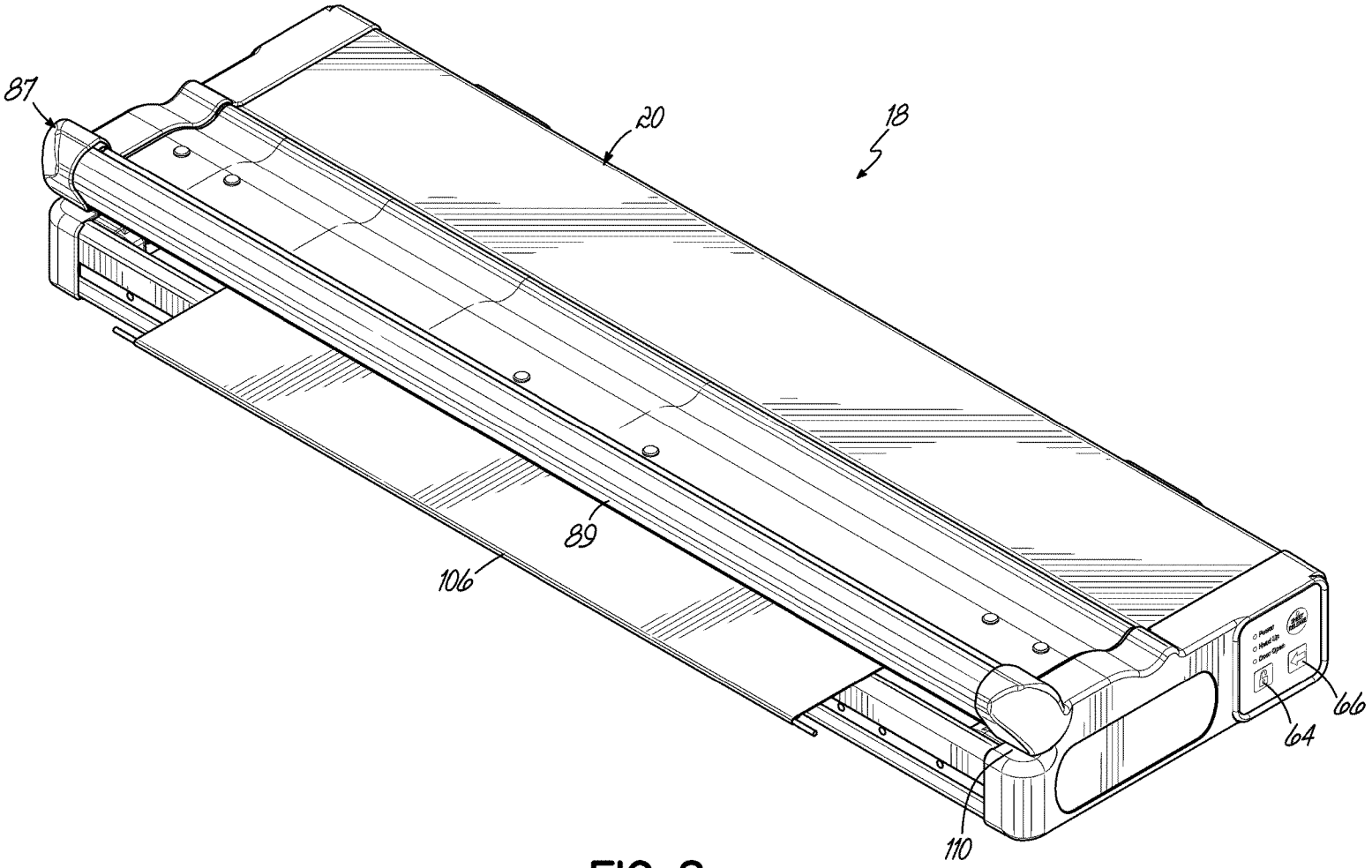
FIG. 2 is a perspective view of the sheet receiver shown in FIG. 1A.
Figure 3:
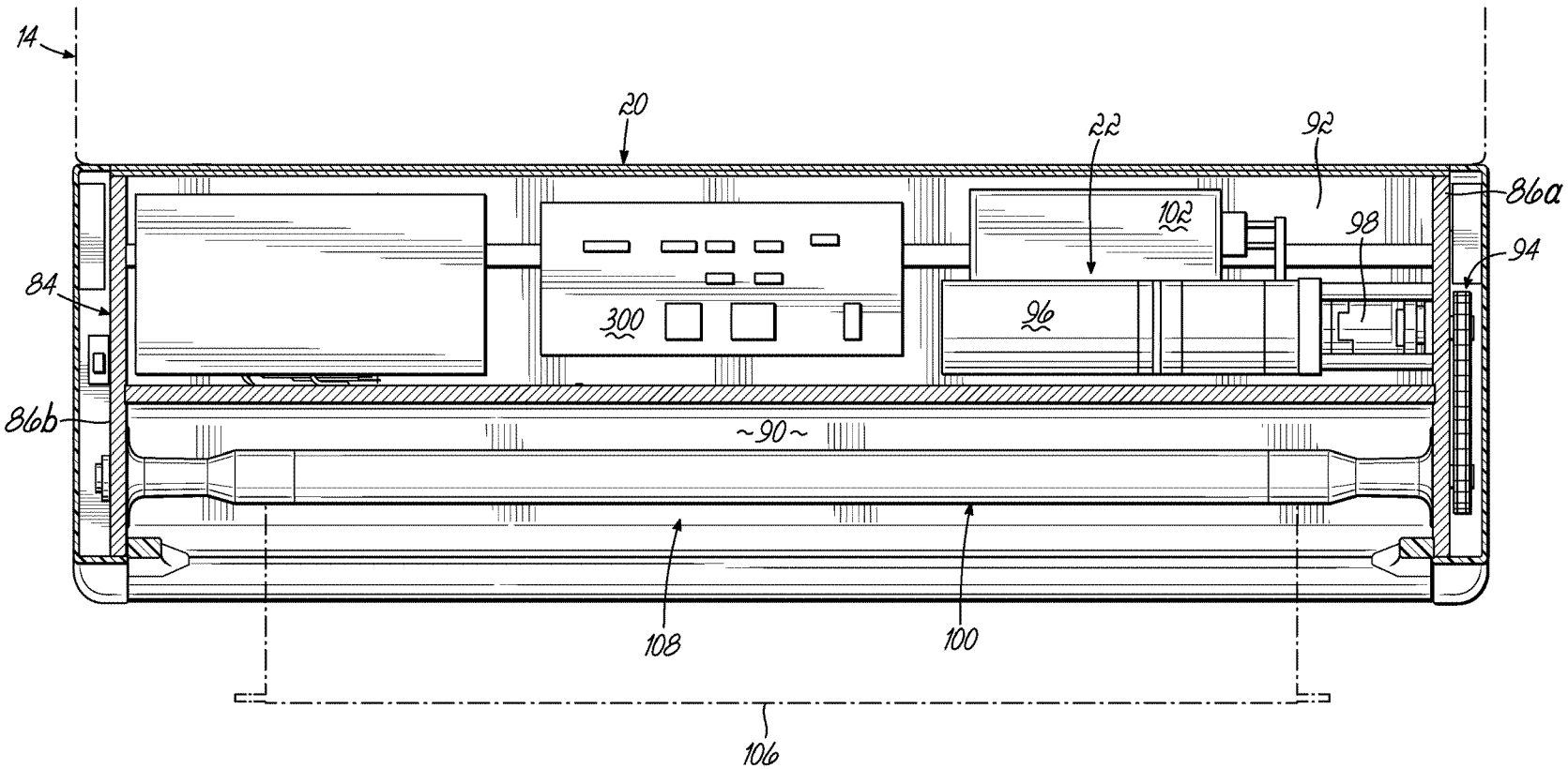
FIG. 3 is a top schematic view of the sheet receiver shown in FIG. 2, with the top panel removed.

As shown in FIGS. 2 and 3, the sheet receiver 18 includes a housing 20 that has a housing frame 84 that includes a pair of lateral support members 86*a*, 86*b* and a central cross member 88. The central cross member 88 extends perpendicularly between the pair of lateral support members 86*a*, 86*b* and divides the space within the housing 20 into a sheet chamber 90 and a drive chamber 92. Additionally, the housing 20 includes an extension 87 protruding horizontally along the length of the housing 20 and above the slot 110. According to an exemplary embodiment of the invention, the extension 87 defines a lip 89 against which the head end piece 74 abuts when the sheet receiver 18 is positioned within the volume envelope 78.

As shown and described in applicant's '170 application, the sheet receiver 18 may incorporate a chain drive portion 94 driven by a motor 96 connected to a clutch 98 for rotating the roller 100. However, it will be appreciated that other combinations of drive components, such as gears, chains, sprockets, and/or belts, may be used to operatively rotate the roller 100. The drive mechanism 22 also includes a power source 102, a controller 104, and a motor 96. A connector 106 extends from the roller 100 to at least partially define a pulling device 108 operatively driven by the drive mechanism 22 contained within the sheet receiver 18. The connector 106 is configured to removably connect to a sheet 16, such that the pulling device 108 pulls the sheet 16 through a slot 110 formed in the housing 20.

Applicant's '185 application, published as U.S. Patent Publication No. 2014/0259389, describes one example of a patient repositioning system in paragraphs [0080]-[0083] and paragraphs [0113] and [0114]. That general description is applicable here and is again referred to here.

Thus, the present invention contemplates various embodiments for adapting the patient repositioning system 10 disclosed in the '185 application and '170 application to a bariatric bed 12. Generally, the patient repositioning system 10 includes a mattress 14 having a mattress head end 54, a mattress foot end 52 and an upper mattress surface 46, a sheet 16 residing on the upper mattress surface 46, a drive mechanism 22 operatively coupled to the sheet 16 and adapted to pull the sheet 16 toward the mattress head end 54, and a housing 20 holding the drive mechanism 22.

Figure 4A:
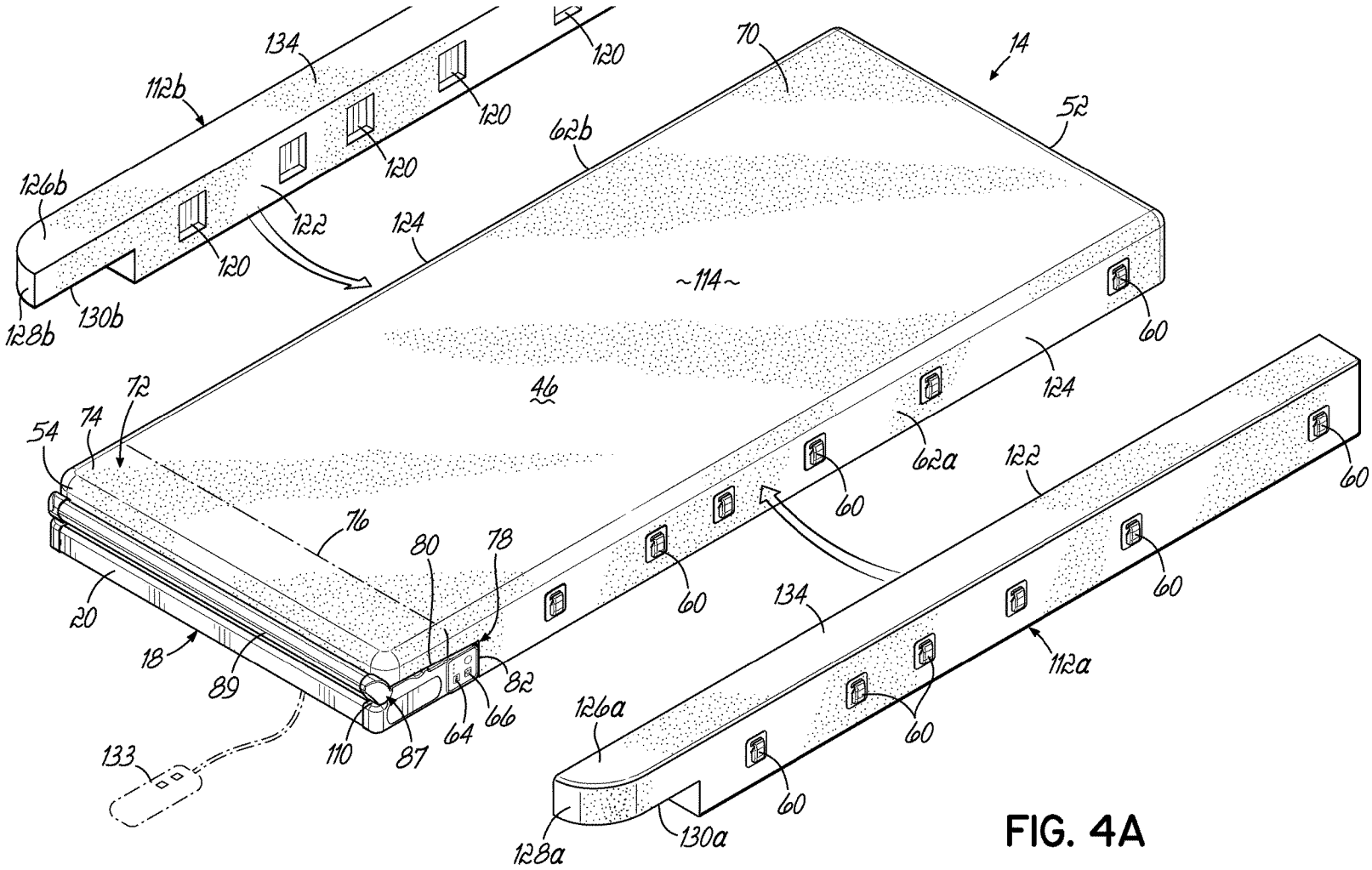
FIG. 4A is a perspective view of a mattress, a sheet receiver, and a pair of operatively coupled side bolsters prior to attachment according to a first exemplary embodiment of the invention.
Figure 4B:
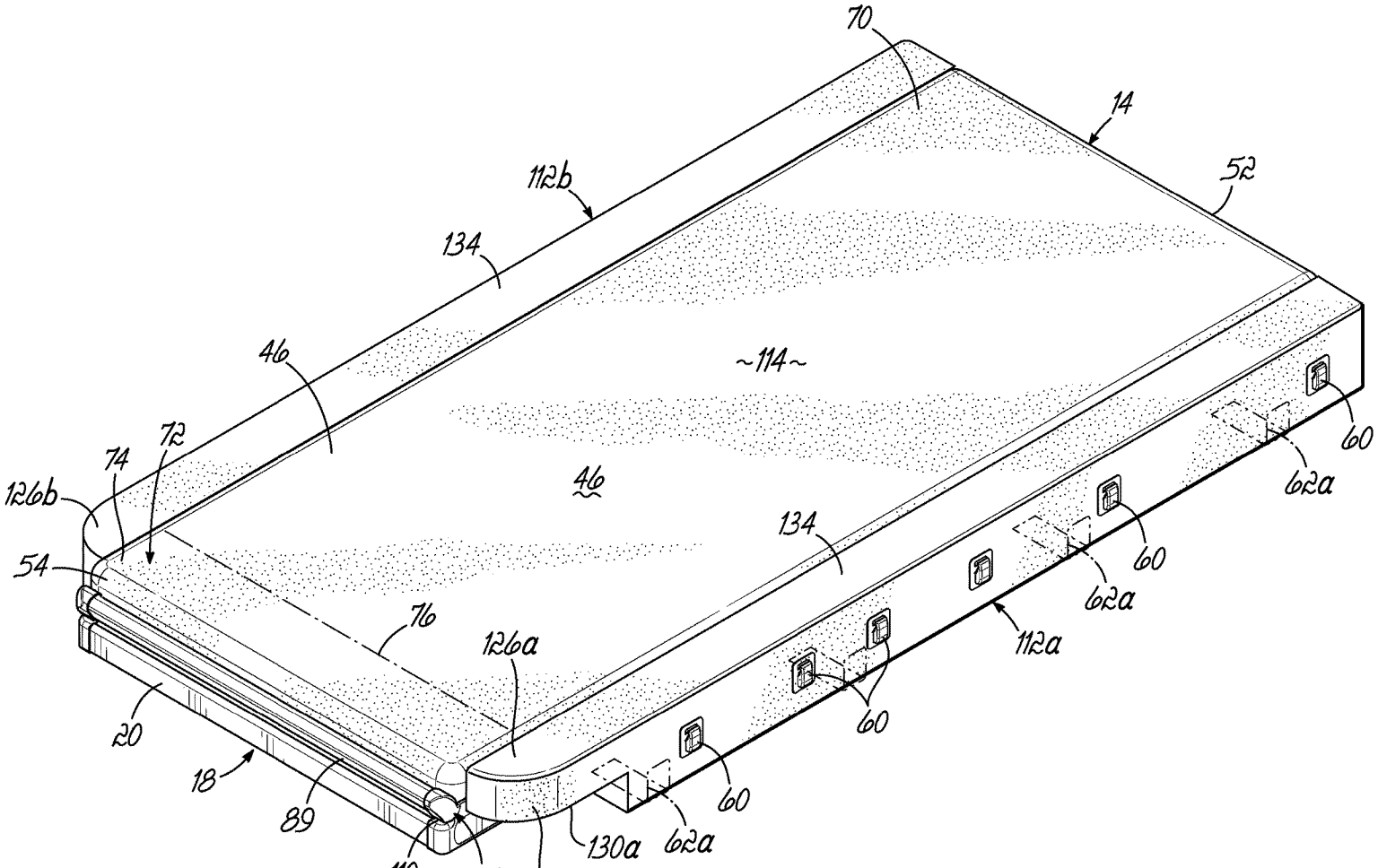
FIG. 4B is a perspective view similar to FIG. 4A, but with the pair of operatively coupled side bolsters already attached.

FIGS. 4A, 4B, 5A and 5B, show a first exemplary embodiment of the invention, where a patient repositioning system 10 includes a pair of side bolsters 112*a*, 112*b* located along opposing longitudinal sides 62*a*, 62*b* of the body portion 114 of the mattress 14 to widen the upper mattress surface 46. As a result, the mattress 14 and the sheet receiver 18 may be of a standard size. While FIGS. 4A-5A show a pair of side bolsters 112*a*, 112*b*, a single side bolster (not shown) located along either longitudinal side 62*a*, 62*b* of the body portion 114 may be suitably utilized to decrease the number of additional components needed to widen the upper mattress surface 46. It should be understood by those skilled in the art that the side bolsters 112*a*, 112*b* may be releasably attached, or alternatively, may be permanently connected to the bariatric bed 12. As shown in FIG. 4B, one or more supports 116 may be provided in the bariatric bed 12 underneath the side bolsters 112*a*, 112*b* to provide vertical support for the side bolsters 112*a*, 112*b*. Additionally, these supports 116 may collapse internally into the bariatric bed frame 24 or the mattress 14.

Figure 5A:
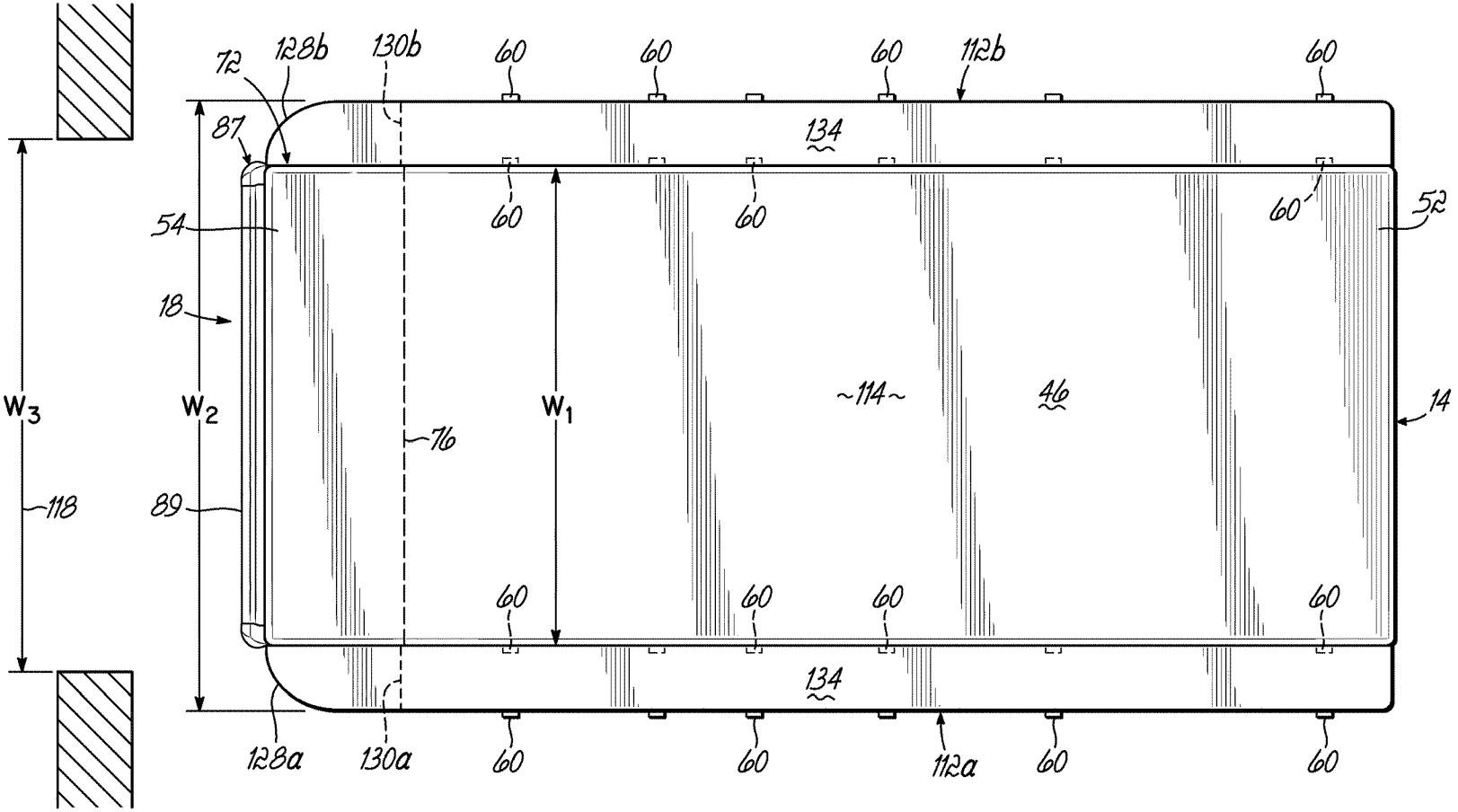
FIG. 5A is a top schematic view of FIG. 4B with the pair of side bolsters each operatively coupled to the body portion of the mattress and the system next to a doorway.
Figure 5B:
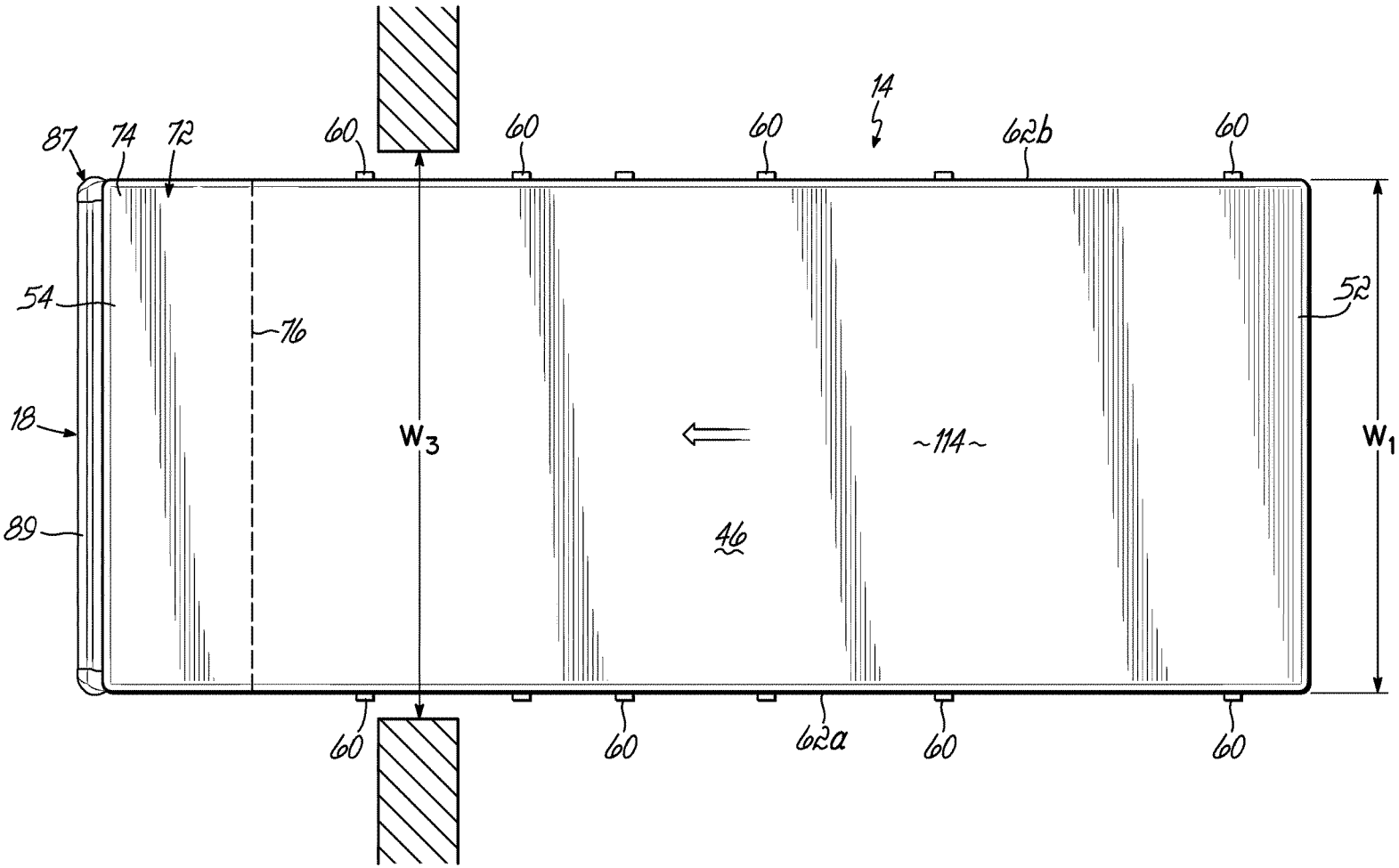
FIG. 5B is a top schematic view of FIG. 4A with the pair of side bolsters removed and the system passing through a doorway.

Releasably attaching the side bolsters 112*a*, 112*b* provides the additional benefit of enabling the bariatric bed 12 to fit through a standard size doorway 118. As shown in FIG. 5A, this exemplary embodiment includes the mattress 14 and sheet receiver 18 having a first width W1 of about 39 inches (as generally disclosed in the '185 application and the '170 application), and two side bolsters 112*a*, 112*b*, each of which is about 4.5 inches wide. Each of the side bolsters 112*a*, 112*b* is operatively coupled to a corresponding longitudinal side 62*a*, 62*b* of the mattress 14. As a result, the bariatric bed 12 with the side bolsters 112*a*, 112*b* attached has a second width W2 of about 48 inches, which is more than the third width W3 of a standard size doorway 118 of about 42 inches. As a result, the bariatric bed 12 with the side bolsters 112*a*, 112*b* attached is unable to fit through a standard size doorway 118 having a third width W3. However, with the side bolsters 112*a*, 112*b* removed as shown in FIG. 5B, the bariatric bed 12 has a first width W1 of about 39 inches, thereby allowing the bariatric bed 12 to fit through the standard size doorway 118 without issue. As a result, the bariatric bed 12, with or without the patient in the bariatric bed 12, may be transported between rooms.

As shown and described in the '185 application, the body portion 114 may include at least one row of one or more retainers 60. Because the mattress 14 of the '185 application has a plurality of retainers 60, the side bolsters 112*a*, 112*b* include a corresponding number of voids 120 on a vertically oriented inner surface 122 located adjacent the body portion 114 as shown in FIG. 4A. These voids 120 allow the side bolsters 112*a*, 112*b* to accommodate the retainers 60 on the corresponding vertically oriented outer surface 124 of the mattress longitudinal sides 62*a*, 62*b*. As a result, the retainers 60 of the body portion 114 are substantially covered by the operatively coupled side bolsters 112*a*, 112*b*. These voids 120 can be helpful in properly locating or aligning the side bolsters 112*a*, 112*b*. The side bolsters 112*a*, 112*b* preferably include at least one row of one or more retainers 60 adapted to retain a corresponding beaded edge 56 of the sheet 16.

The side bolsters 112*a*. 112*b* may be formed a compressible material, inflated and deflated using air inflatable bladders, or some combination thereof. If desired, the side bolsters 112*a*, 112*b* may have a firmer head end 126*a*, 126*b* to limit the compressibility of the side bolsters 112*a*, 112*b* and to better guide the sheet 16 into the drive mechanism 22. As shown in FIGS. 4A-5A, the side bolsters 112*a*, 112*b* curve inwardly 128*a*, 128*b* toward the sheet receiver 18 at the head end 126*a*, 126*b* to better guide the sheet 16 into the drive mechanism 22. The housing 20 holds the drive mechanism 22, which operatively couples to the sheet 16 and is adapted to pull the sheet 16 toward the head end 36. As shown, the side bolsters 112*a*, 112*b* may include cutout portions 130*a*, 130*b* near the head end 126*a*, 126*b* to accommodate the user interface 132 containing the enabling switch 64 and the drive switch 66. Alternatively, as shown in broken lines in FIG. 4A, a user interface pendant 133 may be used instead of the cutout portions 130*a*, 130*b* to operatively communicate with the patient repositioning system 10. Specifically, the user interface pendant 133 may be hardwired to the patient repositioning system 10 using a detachable cable or may communicate wirelessly with the patient repositioning system 10.

The operation of this exemplary embodiment would occur in much the same manner as shown and described in the '185 application. However, unlike the '185 application, a sheet 16 having a greater width would be utilized, such as a sheet 16 having a width of about 48 inches residing on the upper mattress surface 46 and upper surface 134 of the side bolsters 112*a*, 112*b*. This effectively widens the upper mattress surface 46 which the patient may utilize. Additionally, the sheet 16 would be retained by retainers 60 located on the side bolsters 112*a*, 112*b* instead being retained by the retainers 60 located on the body portion 114 as shown and described in the '185 application. Further, the sheet 16 would be pulled into the slot 110 from the second width W2, instead of from the first width W1.

Figure 6:
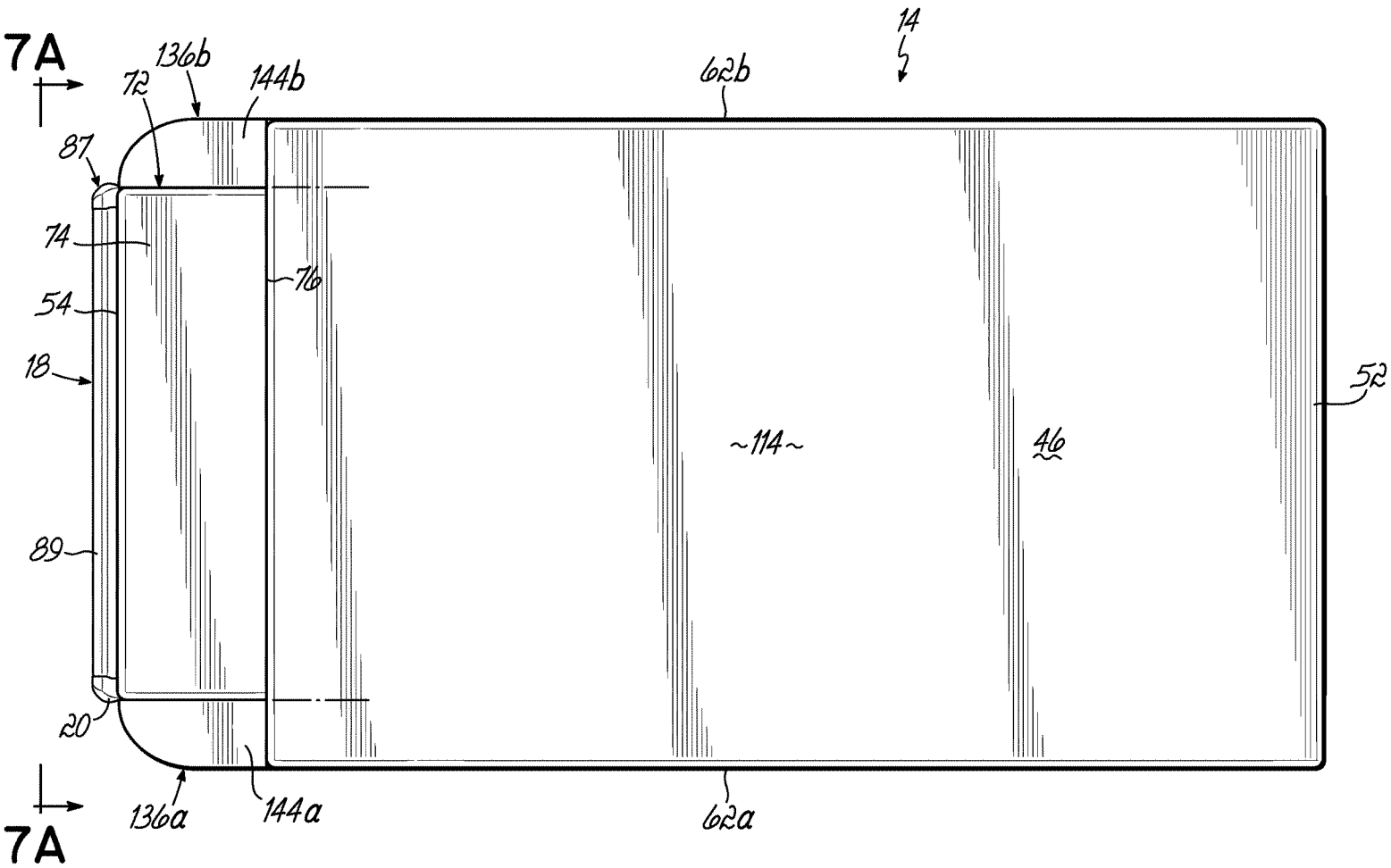
FIG. 6 is a top schematic view of a mattress, a sheet receiver, and a pair of transition pieces, namely pivoting ledges, located at the head end of the mattress, on opposite sides of the housing.
Figure 7A:
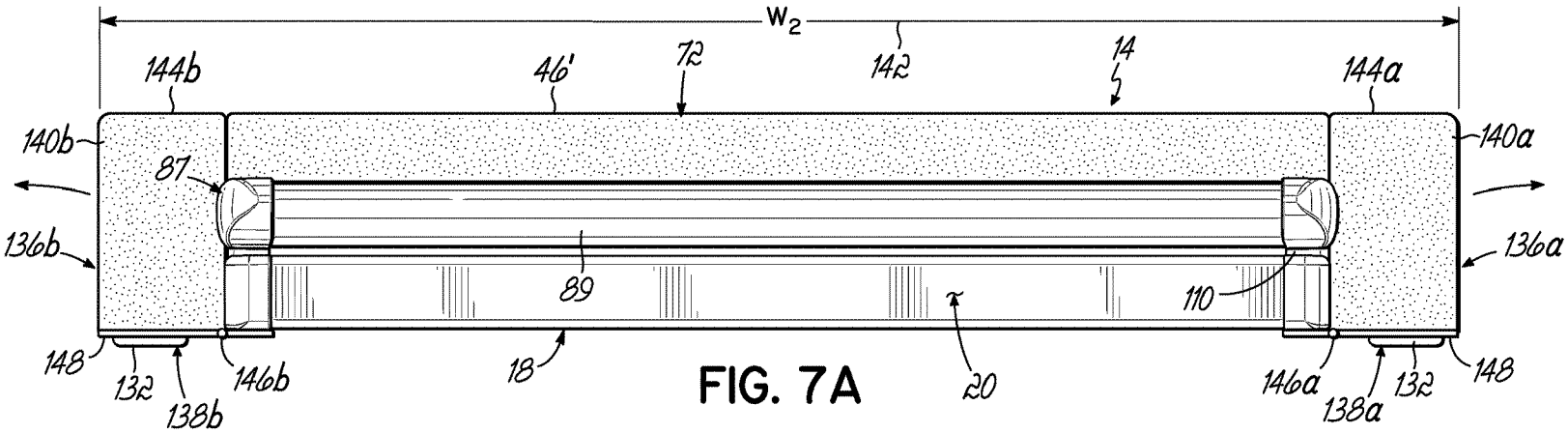
FIG. 7A is a front view similar to FIG. 6, but with a pair of pivoting ledges and additional mattress sections in a first position.
Figure 7B:
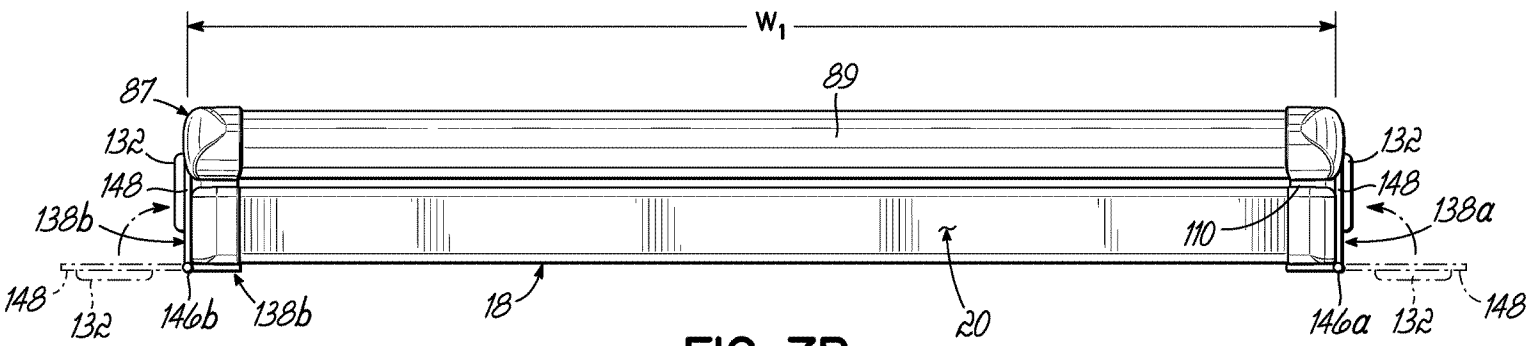
FIG. 7B is a front schematic view of FIG. 6, but with a pair of pivoting ledges in a second position.

FIGS. 6, 7A, and 7B show a second exemplary embodiment of the invention, where a patient repositioning system 10 includes a pair of transition pieces 136*a*, 136*b*, specifically a pair of pivoting ledges 138*a*, 138*b* which hold a pair of mattress sections 140*a*, 140*b*. The pair of pivoting ledges 138*a*, 138*b* and mattress sections 140*a*, 140*b* are located near the mattress head end 54, on opposite sides of the housing 20 of the sheet receiver 18, to facilitate pulling the sheet 16 into the housing 20 during operation. Specifically, FIG. 6 shows a mattress 14 having a width of about 48 inches, a sheet receiver 18 having a width of about 39 inches (as generally disclosed in the '185 application), and two pivoting ledges 138*a*, 138*b* each having a width of about 4.5 inches.

The pair of pivoting ledges 138*a*, 138*b* enable the head end 36 of the bariatric bed 12 to adjust between a second width W2 as shown in FIG. 7A and a first width W1 as shown in FIG. 7B. Specifically, FIG. 7A shows the pair of pivoting ledges 138*a*, 138*b* holding a pair of mattress sections 140*a*, 140*b* disposed opposite the head end section 72 of the mattress 14 to form an upper surface 142 of the bariatric bed 12 having a second width W2 of about 48 inches. Upper surface 142 includes upper mattress surface 46 as well as the upper mattress section surfaces 144*a*, 144*b*. As shown in FIG. 6 and more clearly in FIG. 7A, the pivoting ledges 138*a*, 138*b* may rotate downward along respective horizontal pivot points 146*a*, 146*b* to form a surface that is generally flush with the bottom of the sheet receiver 18. The pivoting ledges 138*a*, 138*b* are locked into place while in use. When the pivoting ledges 138*a*, 138*b* are not in use, the pivoting ledges 138*a*, 138*b* are rotated inwardly upward toward the sheet receiver 18, while the mattress sections 140*a*, 140*b* are removed as shown in FIG. 7B. This results in the width of the head end 36 being reduced to about 39 inches. Although not shown, the two pivoting ledges 138*a*, 138*b* may alternatively be as wide as the thickness of the sheet receiver 18 and the head end section 72 combined, to allow the pivoting ledges 138*a*, 138*b* not to extend above the upper mattress surface 46 while not in use. Additionally, the mattress 14 and the bariatric bed frame 24 may be compressed to allow passage through a standard size doorway 118. As a result, the entire bariatric bed 12 including the patient repositioning system 10 may pass through a standard size doorway 118 and travel from room to room.

Because the drive mechanism 22 is contained within the head end section 72 of the bariatric bed 12, the drive mechanism 22 may have a width dimension less than the width of the mattress 14. Additionally, one or more user interfaces 132 may be placed on the outer ledge surface 148 because access to the enabling switch 64 and the drive switch 66 of the sheet receiver 18 may be restricted due to pivoting ledges 138*a*, 138*b*. One suitable type user interface 132 is a membrane touch type, which has a slim profile yet allows the desired level of control. Alternatively, a user interface pendant 133 may be used instead of the user interfaces 132 to operatively communicate with the patient repositioning system 10. Specifically, the user interface pendant 133 may be hardwired to the patient repositioning system 10 using a detachable cable or may communicate wirelessly with the patient repositioning system 10. The pair of pivoting ledges 138*a*, 138*b* and mattress sections 140*a*, 140*b* may curve inwardly at the head end 36 of the bariatric bed 12 to help direct the sheet 16 into the slot 110 of the sheet receiver 18. In this embodiment, the mattress sections 140*a*, 140*b* may include at least one row of one or more retainers 60 (not shown) adapted to retain a corresponding edge of the sheet 16.

Figure 8:
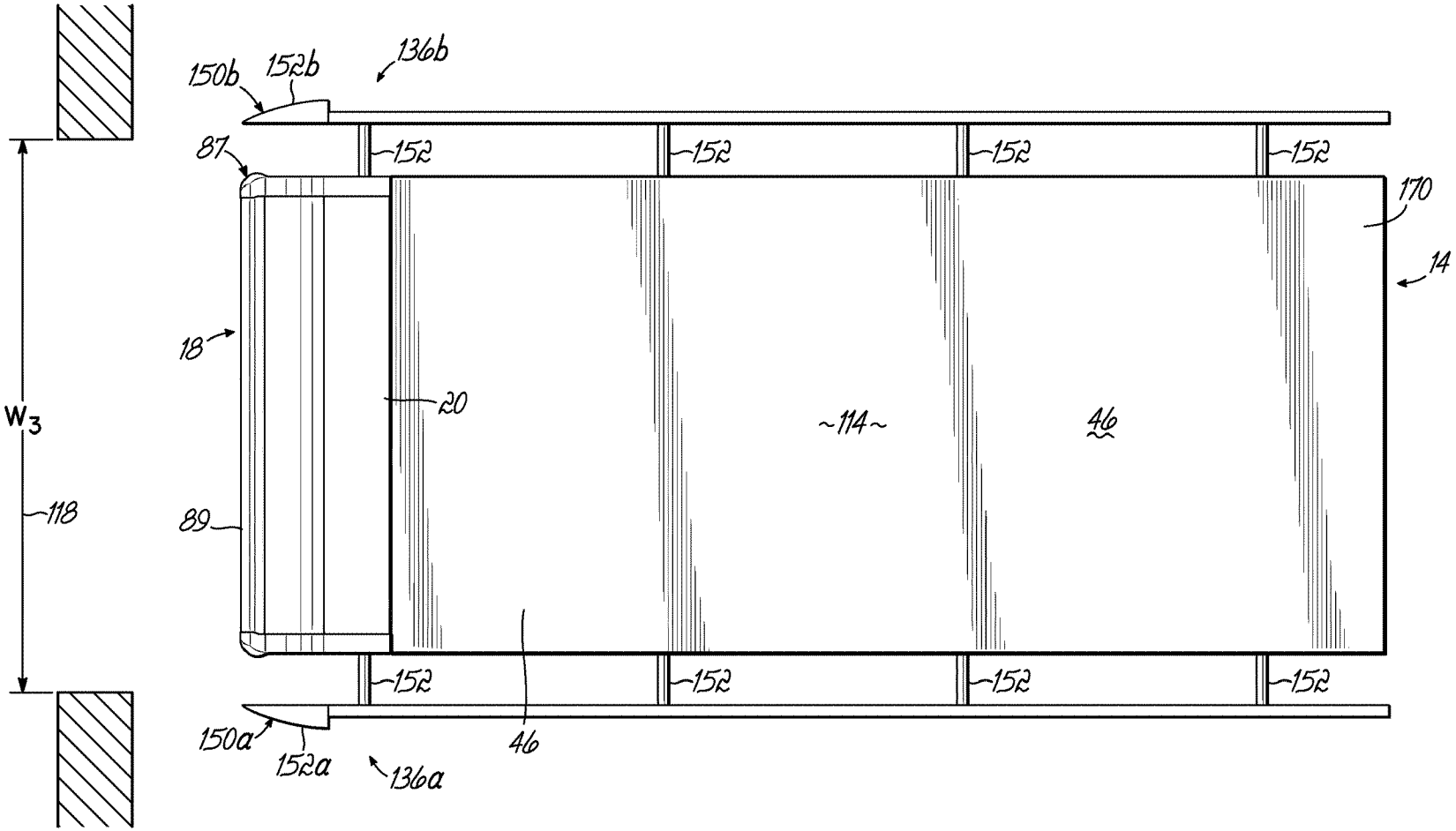
FIG. 8 is a top schematic view where the transition pieces are wings.

As an alternate to a pair of pivoting ledges 138*a*, 138*b*, FIG. 8 shows and describes a pair of wings 150*a*, 150*b* that extend outwardly from the bariatric bed 12. As shown, the pair of wings 150*a*, 150*b* are located near the mattress head end 54, on opposite sides of the housing 20 of the sheet receiver 18, to facilitate pulling the sheet 16 into the housing 20 during operation. The wings 150*a*, 150*b* may be extended by pulling outwardly thereon and collapsed by pushing inwardly thereon. The wings 150*a*, 150*b* may be connected to the bariatric bed 12 using extension bars 152. With a mattress 14 and a sheet receiver 18 both having a standard width, typically 39 inches, the wings 150*a*, 150*b* may be mounted to opposite sides of the mattress 14.

The shape of these wings 150*a*, 150*b* may be used to help feed the sheet 16 into the slot 110 at the mattress head end 54. For instance, as shown in FIG. 8, the wings 150*a*, 150*b* curve inwardly 152*a*, 152*b* toward the sheet receiver 18. Also, as shown, the pair of wings 150*a*, 150*b* may extend along the entire longitudinal direction of the mattress 14. Wings 150*a*, 150*b* may be independently mounted to opposite sides of the bariatric bed 12, mounted on opposite sides of a longitudinal member (not shown) that extends widthwise underneath the mattress 14, and/or attached to the bed deck 26 (see FIGS. 1A-1C). The wings 150*a*, 150*b* may be equipped with retainers 60 or other structure for holding the side edges of the sheet 16 at a desired spacing.

Additionally, one or more user interfaces 132 may be placed on wings 150*a*, 150*b* because access to the enabling switch 64 and the drive switch 66 of the sheet receiver 18 may be restricted due to wings 150*a*, 150*b*. One suitable type user interface 132 is a membrane touch type, which has a slim profile yet allows the desired level of control. Alternatively, a user interface pendant 133 may be used instead of the user interfaces 132 to operatively communicate with the patient repositioning system 10. Specifically, the user interface pendant 133 may be hardwired to the patient repositioning system 10 using a detachable cable or may communicate wirelessly with the patient repositioning system 10.

FIGS. 9, 10A, 10B, and 10C show a third exemplary embodiment of the invention, wherein the housing 20 of the sheet receiver 18 expands and contracts in length to match the widthwise dimension of the mattress 14 and/or the bariatric bed frame 24 of the bariatric bed 12. More specifically, the sheet receiver 18 includes a housing 20 and a drive mechanism 22 that is operatively coupled to the sheet 16, with the drive mechanism 22 being adapted to pull the sheet 16 toward the head end 54.

Figure 9:
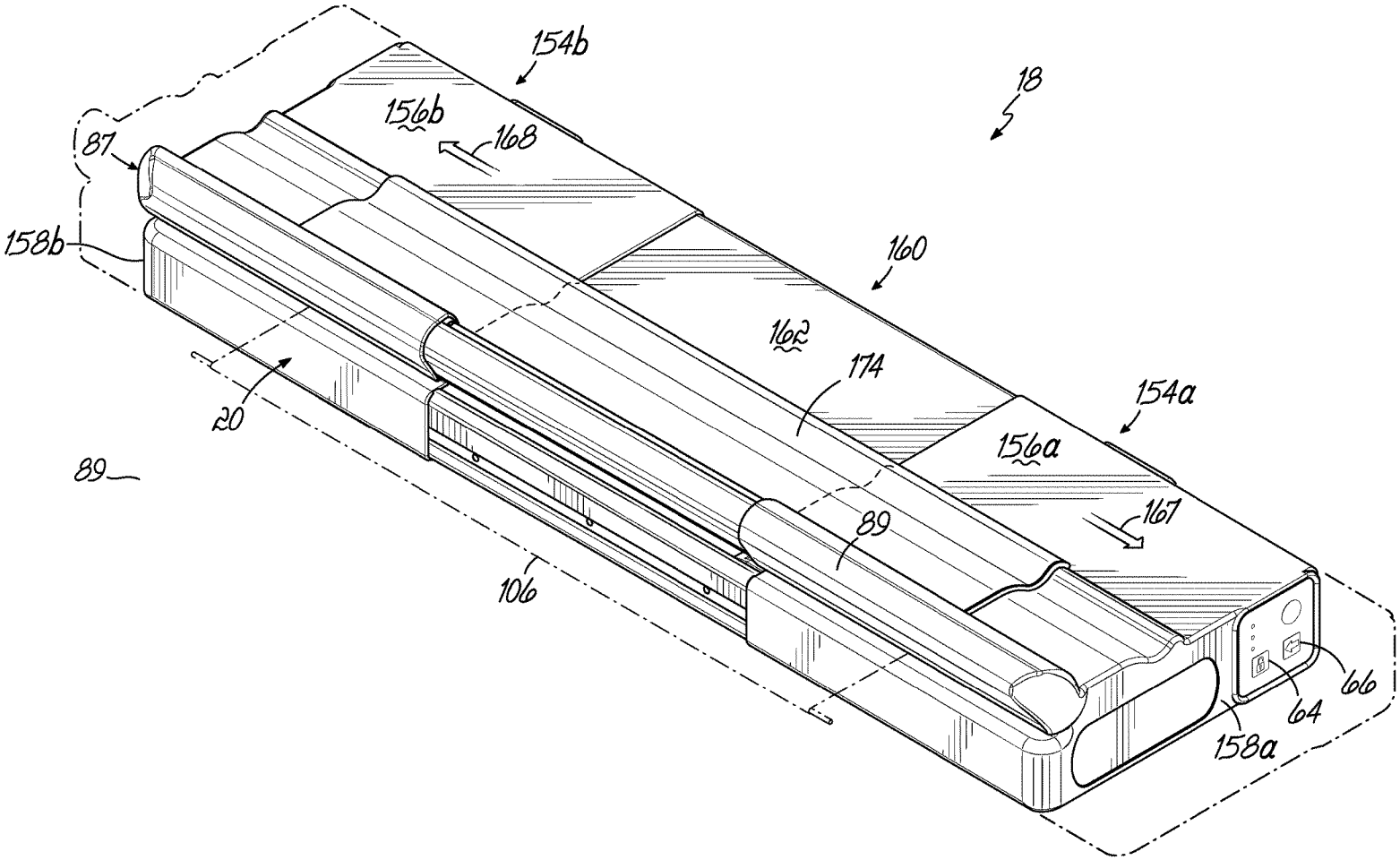
FIG. 9 is a perspective view of an exemplary embodiment of the sheet receiver with a housing that expands/contracts in length.

As shown in FIG. 9, the sheet receiver 18 includes two outer slideable sections 154*a*, 154*b* having respective outer slideable section surfaces 156*a*, 156*b* and vertical sidewalls 158*a*, 158*b*. Between the outer slideable sections 154*a*, 154*b* is an inner slideable section 160 having an inner slideable section surface 162. The outer slideable section surfaces 156*a*, 156*b* generally face and move relative to the inner slideable section surface 162. The outer slideable section surfaces 156*a*, 156*b* and the inner slideable section surface 162 overlap to create overlapping surfaces 164*a*, 164*b*. This permits the housing 20, with the inner slideable section 160, outer slideable sections 154*a*, 154*b*, and overlapping surfaces 164*a*, 164*b*, to be telescopically expanded and contracted without exposing the internal volume 166 of the housing 20. This telescoping capability enables the vertical sidewalls 158*a*, 158*b* to move outwardly (arrows 167, 168 in FIGS. 9 and 10A) to expand, as shown in broken lines, and also to move inwardly (arrows 170, 172 in FIG. 10C) to contract the housing 20 when deployed/moved. As shown in FIG. 9, the access door 174 for the sheet receiver 18 overlaps the outer slideable sections 154*a*, 154*b*, and thus is also expandable and contractable.

Figure 10A:
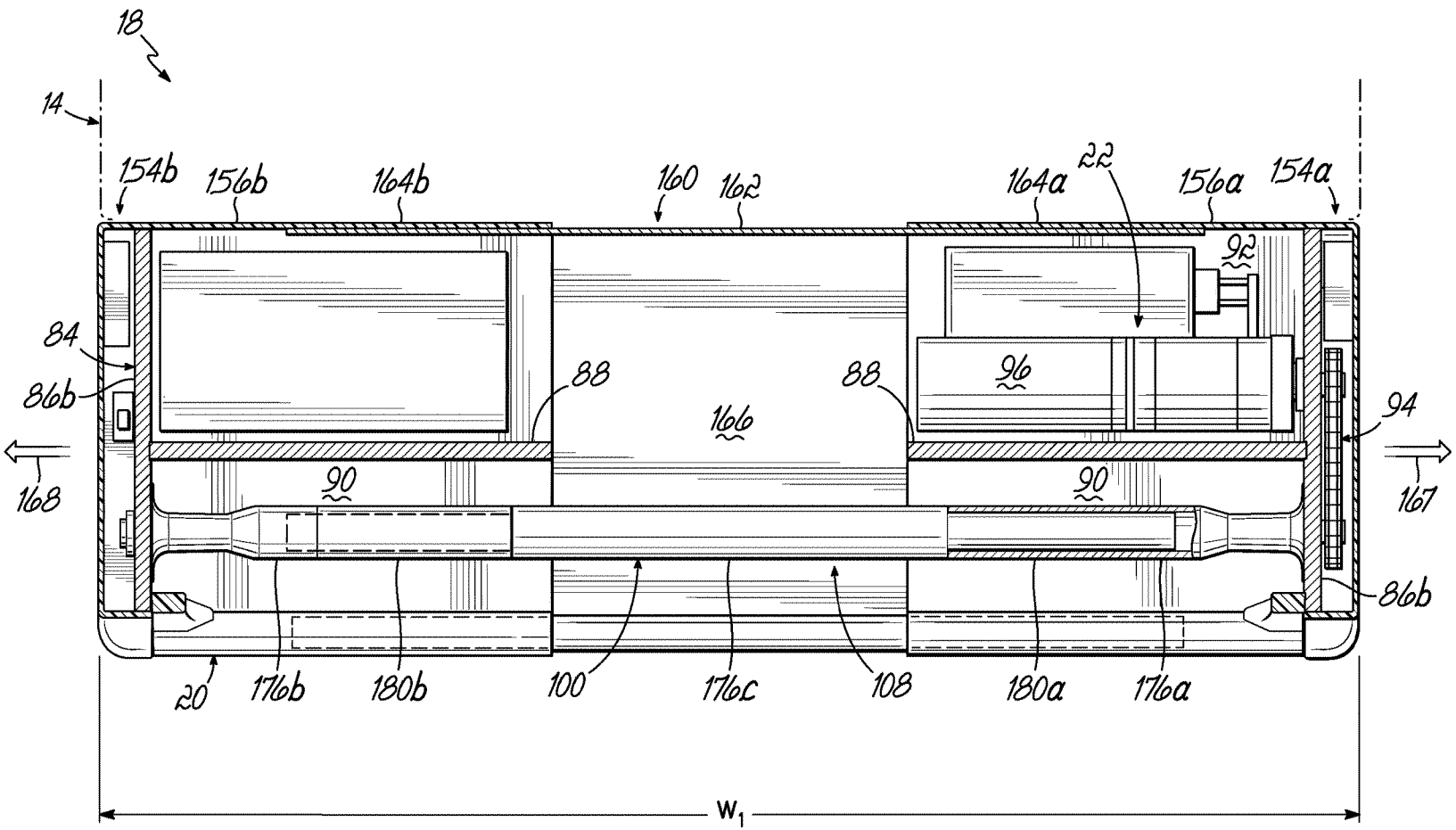
FIG. 10A is a top schematic view of the sheet receiver shown in FIG. 9 in a contracted position.
Figure 10B:
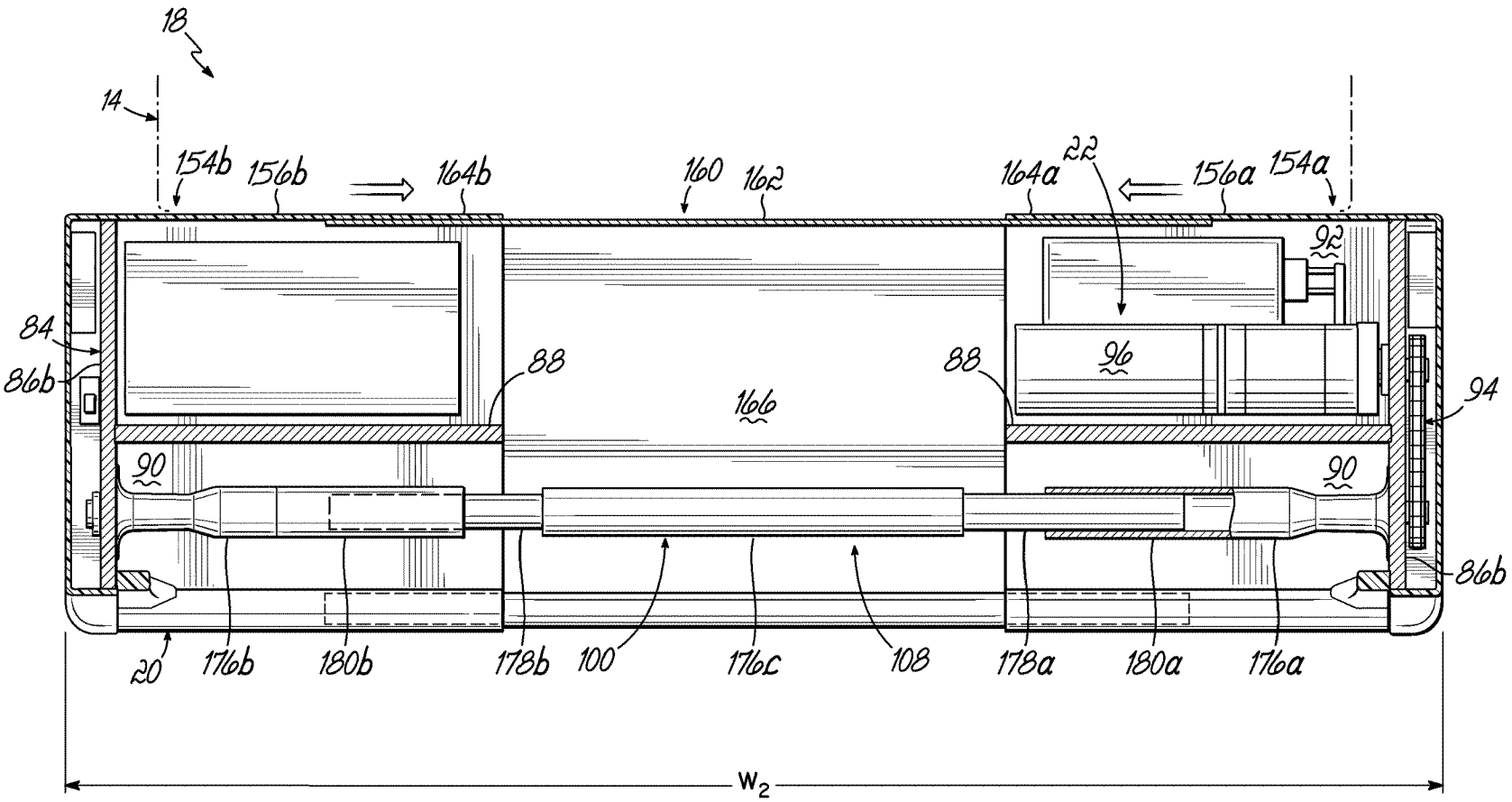
FIG. 10B is a top schematic view of the sheet receiver shown in FIG. 9 in an expanded position.

For example, the vertical sidewalls 158*a*, 158*b* of the sheet receiver 18 may vary to include, for example, desired dimensions of 39 inches, 42 inches, and 48 inches. Further, the housing 20 may include structure such as detented surfaces to positively lock the inner slideable section 160 and outer slideable sections 154*a*, 154*b* in place when deployed to the desired dimension. A contracted position is shown in FIG. 10A, wherein the housing 20 of the sheet receiver 18 has a first width W1 of about 39 inches. As the outer slideable sections 154*a*, 154*b* are moved away from each other, an expanded position is shown in FIG. 10B, wherein the housing 20 has a second width W2 of about 48 inches.

To permit the drive mechanism 22 to be telescopically expanded and contracted, the drive mechanism 22 includes outer slideable pieces 176*a*, 176*b*, 176*c*, inner slideable pieces 178*a*, 178*b*, and overlapping surfaces 180*a*, 180*b*. FIGS. 10A and 10B also show that the drive mechanism 22 includes roller 100. As the outer slideable pieces 176*a*, 176*b*, 176*c* are moved relative to the inner slideable pieces 178*a*, 178*b*, the overlapping surfaces 180*a*, 180*b* thereof are increased/decreased. Moreover, the drive mechanism 22, specifically roller 100 onto which the sheet 16 is received, may accommodate variable axial lengths. This includes axial lengths of 39 inches, 42 inches, or 48 inches, each of which can be positively locked in place when deployed. Additionally, the drive mechanism 22, including the motor 96 and the power source 102, may be attached to the vertical sidewalls 158*a*, 158*b*.

Figure 10C:
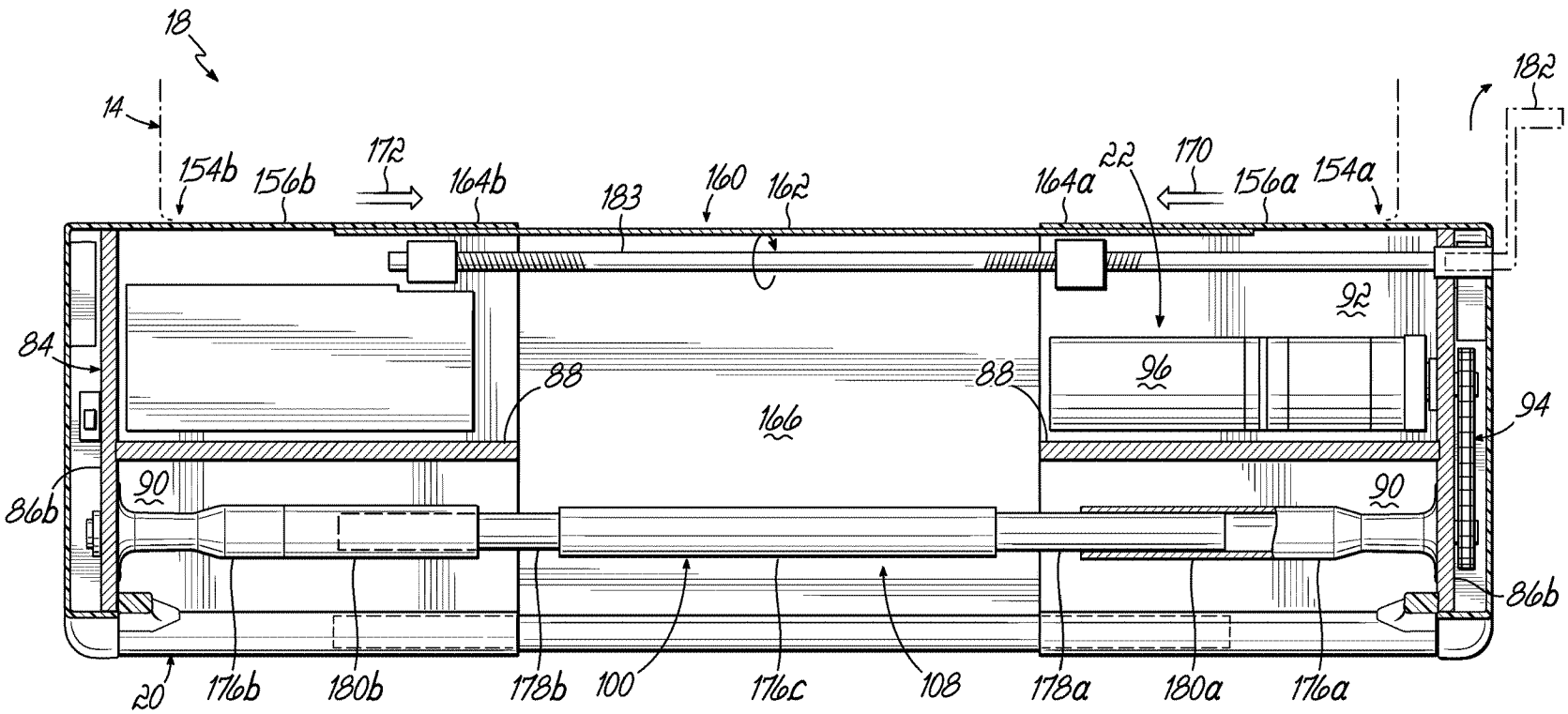
FIG. 10C is a top schematic view of an alternate embodiment of the sheet receiver shown in FIG. 8 in an expanded position.

As shown by broken lines in the top right of FIG. 10C, an external handheld device 182 may be selectively coupled to the sheet receiver 18 to selectively expand and contract the housing 20. As shown, the handheld device rotates a screw 183, which in turn causes the roller 100 to expand and contract. The handheld device 182 may be motorized (using a drill) or may be manually powered (using a crank as shown). The use of a handheld device 182 eliminates the need to locate some or all of the active drive components in the housing 20, and as a result, multiple bariatric beds 12 may be operated by a single handheld device 182. For a facility with a significant number of bariatric beds 12, this would reduce overall costs.

While not shown, the outer slideable sections 154*a*, 154*b* of the sheet receiver 18 may be attached to corresponding portions of the bed deck 26, so as to expand or contract the sheet receiver 18 with the expansion or contraction of the bed deck 26. Further, while not shown, the sheet receiver 18 may alternatively have a single outer slideable section 154*a* and a single inner slideable section 160 that is movable relative to the single outer slideable section 154*a*. In this alternative embodiment, both the inner slideable section 160 and the outer slideable section 154*a* would each include a vertical sidewall 158*a*, 158*b*.

Figure 11:
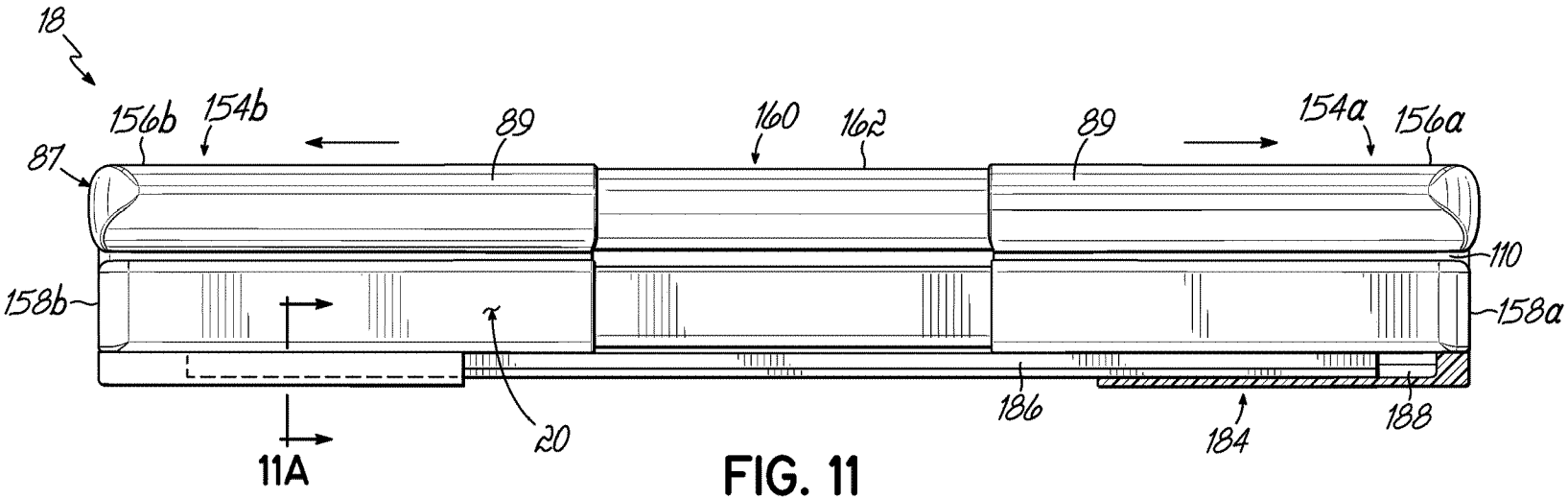
FIG. 11 is a front schematic view of another exemplary embodiment of a sheet receiver in an expanded position.
Figure 11A:
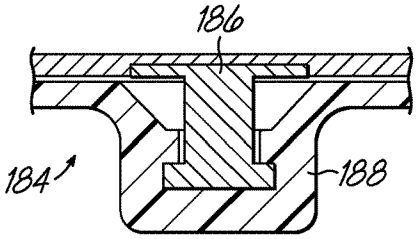
FIG. 11A is a schematic cross-sectional view of the sheet receiver, taken along lines 10A-10A of FIG. 10.

FIGS. 11 and 11A show fourth exemplary embodiment of the invention, which is substantially similar to the previous embodiment, wherein the housing 20 expands and contracts in length to match the widthwise dimension of the mattress 14 and/or the bariatric bed frame 24. More specifically, a track and rail system 184 is located below the sheet receiver 18 to use the available space. A rail 186 slides within a track 188 to expand (as shown by arrows 190 and 192 in FIG. 11) and contract the sheet receiver 18. In addition to such a track and rail system 184, those skilled in the art will appreciate that other mechanisms which provide this expandable and contractable function may prove to be equally suitable.

Figure 12A:
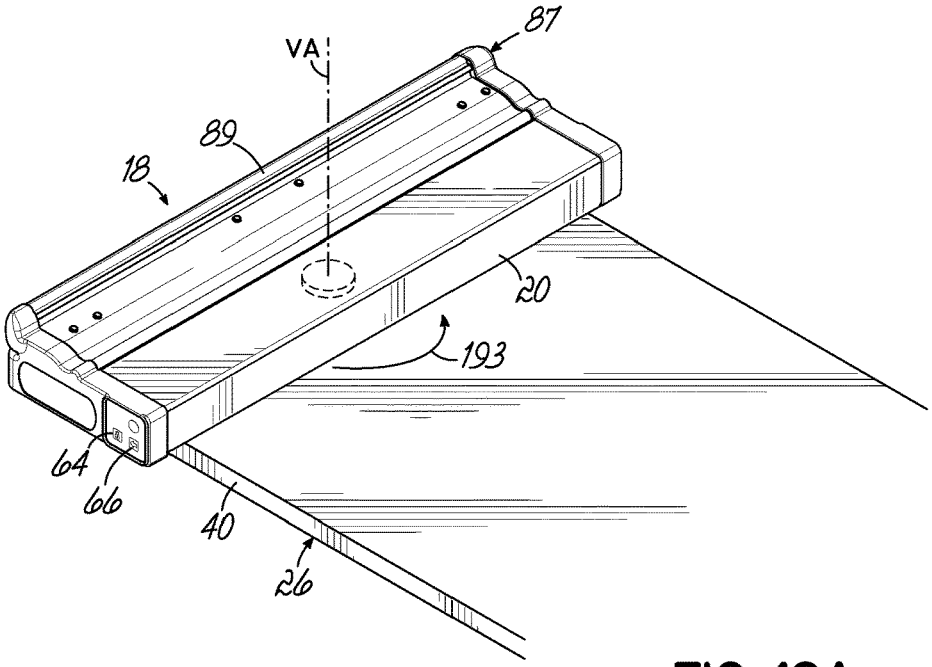
FIG. 12A is a perspective schematic view of another exemplary embodiment where the sheet receiver rotates relative to the bariatric bed frame.
Figure 12B:
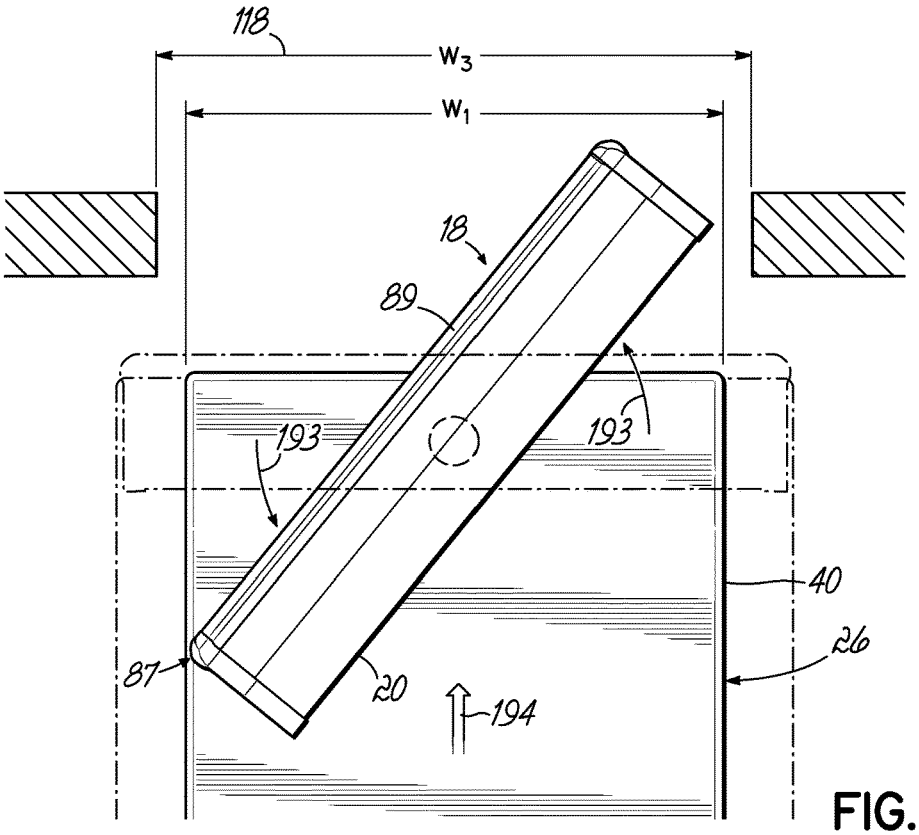
FIG. 12B is a top schematic view of FIG. 12A in rotated position relative to the bariatric bed frame.

FIGS. 12A and 12B show a fifth exemplary embodiment of the invention, wherein the sheet receiver 18 uses a housing 20 that is rotatable, as shown by arrow 193 with respect to a vertical axis VA. This rotatability allows the housing 20 to have a width of about 48 inches when in a non-rotated position, as shown in broken lines in FIG. 12B, but to also have a width of about 39 inches when in a rotated position, as shown in solid lines in FIG. 12B. Additionally, the mattress 14 and the bariatric bed frame 24 which have a width of about 48 inches, may be compressed to a width of about 39 inches to allow passage through a standard size doorway 118 (as shown by arrow 194). As a result of the rotational capability of housing 20, the widthwise dimension of the sheet receiver 18 is reducable to about 39 inches, which is substantially the same as the width of the unexpanded bariatric bed frame 24. As shown and described, the housing 20 pivots about a central vertical axis VA. However, the housing 20 may also be rotatable off center so long as the housing 20 may be reduced to a small enough size to fit through a standard size doorway 118.

Figure 13:
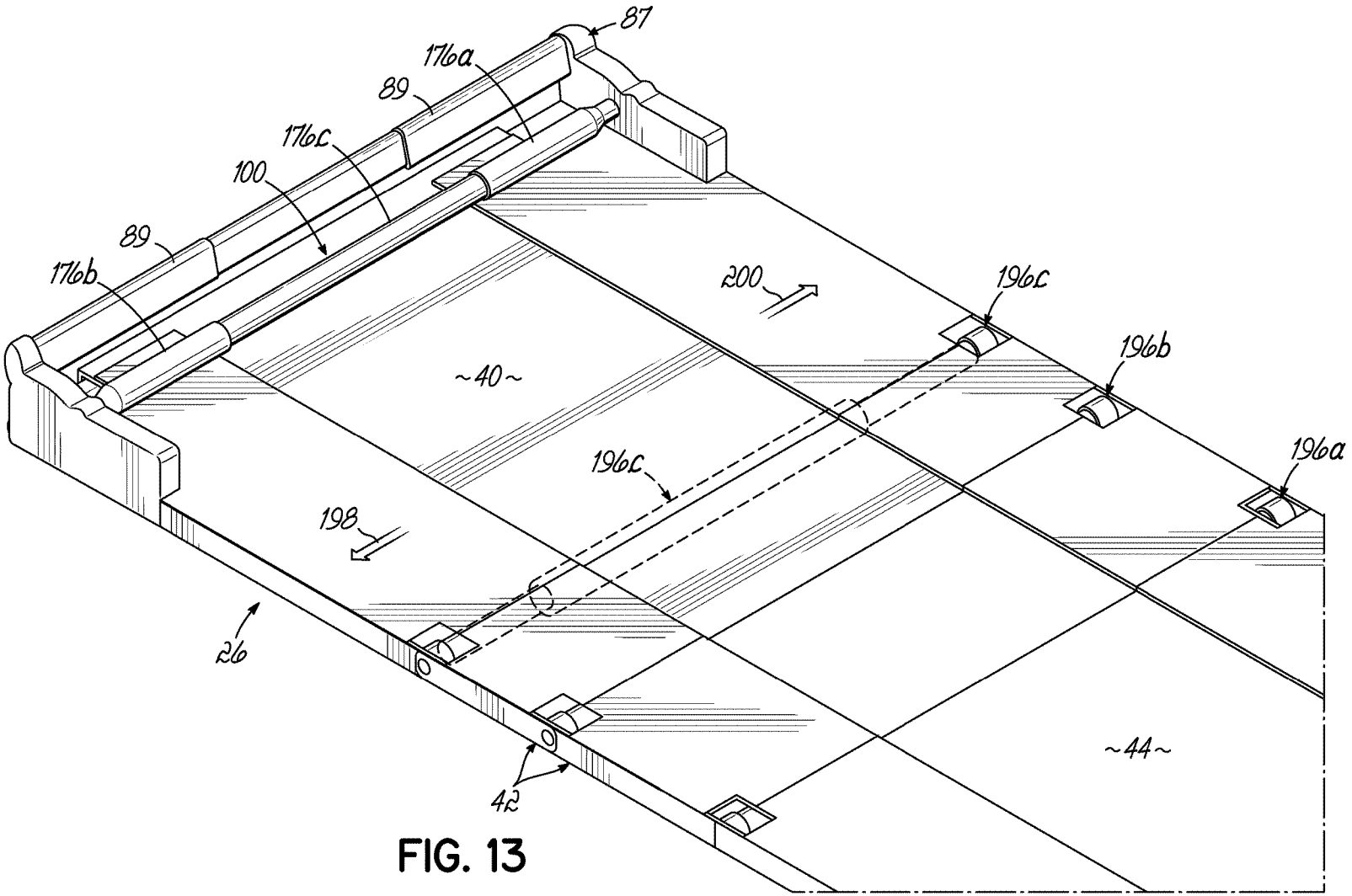
FIG. 13 is a perspective schematic view of an exemplary embodiment of a bariatric bed that expands and contracts in length.
Figure 14A:
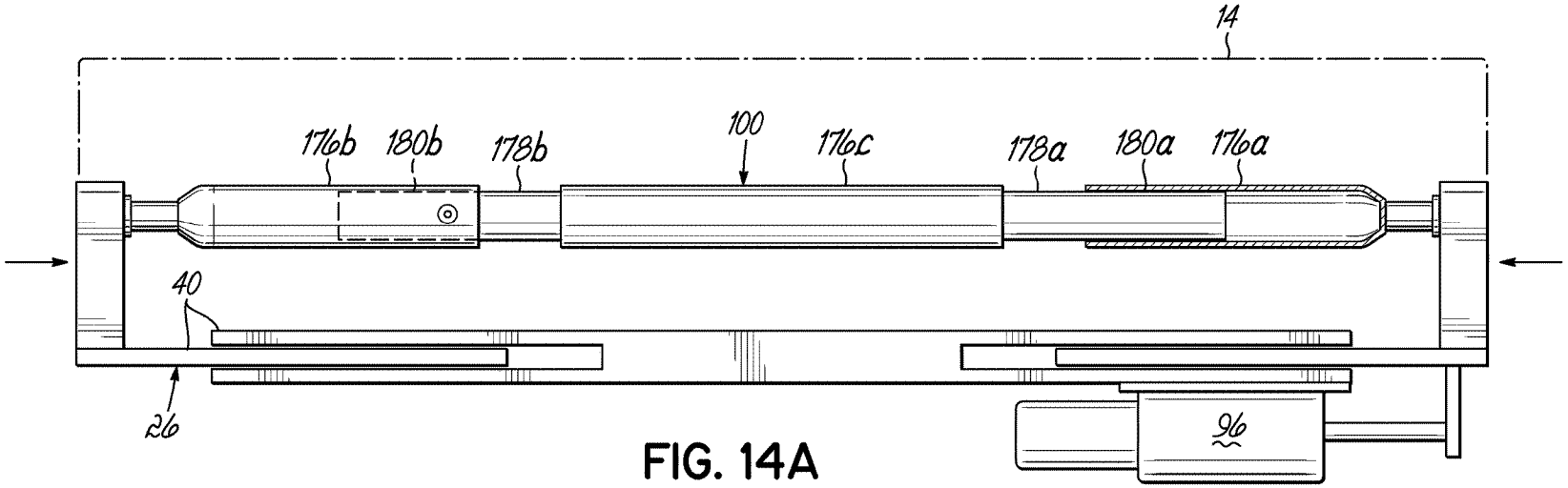
FIG. 14A is a side schematic view of the telescoping mechanism of FIG. 13 in an expanded position.
Figure 14B:
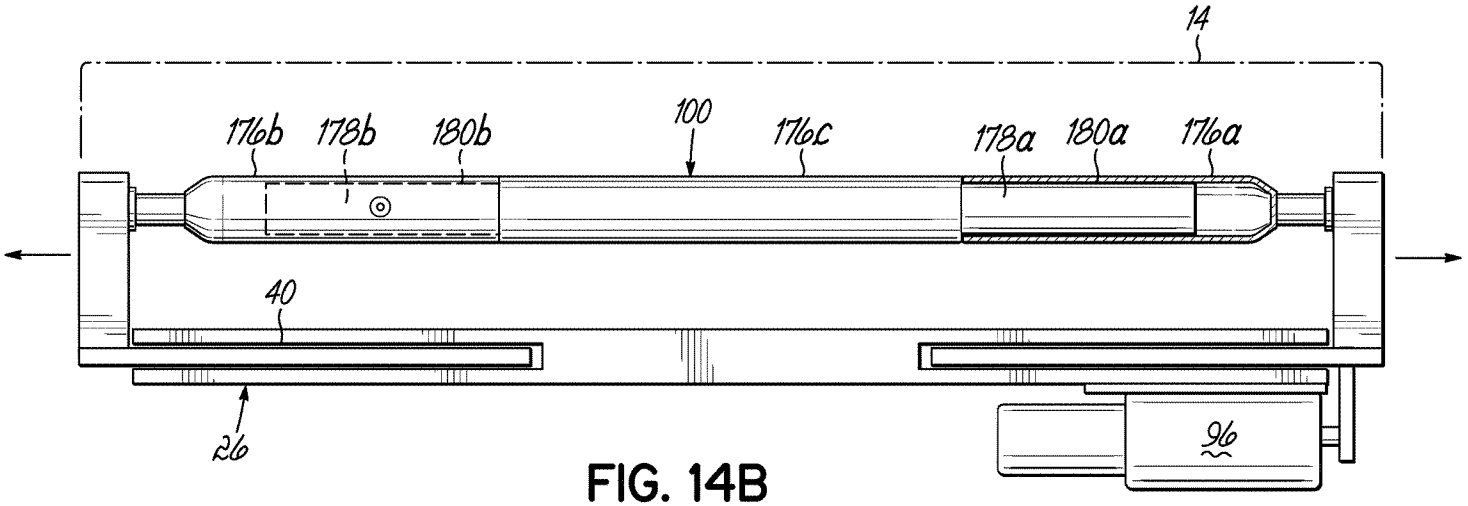
FIG. 14B is a side schematic view of the telescoping mechanism of FIG. 13 in a contracted position.

FIGS. 13, 14A, and 14B show a sixth exemplary embodiment of an integrated system of the invention, wherein the housing 20 and the bariatric bed frame 24 expand and contract together. As shown in FIG. 13, similar to the expansion and contraction of the sheet receiver 18 in FIGS. 10A-10C, the bariatric bed frame 24 includes a plurality of telescoping mechanisms 196 so that the bariatric bed 12 may expand and contract in the widthwise dimension. This widens (as shown by arrows 198 and 200) and narrows the upper mattress surface 46 to accommodate a mattress 14 having a width of about 48 inches. The telescoping mechanisms 196 also expand and contract the widthwise dimension of the housing 20 and drive mechanism 22.

Although not shown, those skilled in the art will appreciate that a power source 102, circuitry (not shown), and controls (not shown) may be integrated into the bariatric bed 12. Also, those skilled in the art would appreciate that actuation of the drive mechanism 22, to pull the patient toward the head end 36 of the bariatric bed 12, may be accomplished by a handheld unit of the type shown and described in the '185 application, which may be a manual hand crank as shown and described in applicant's co-pending U.S. patent application Ser. No. 14/450,813, filed Aug. 4, 2014, entitled "Patient Repositioning System with Hand Crank Capability."

This specification shows and describes some presently preferred embodiments of the present invention which specifically adapt the principles disclosed in the '185 application for use with a bariatric bed 12. However, it should be recognized by those skilled in the art that the embodiments shown and described herein are susceptible to a reasonable degree of modification, without departing from the scope of the invention. Thus, the reader should recognize that this specification is intended to be exemplary in nature, rather than limiting in scope relative to the claims. Moreover, any references to objectives or objects of the invention are intended to facilitate the reader's understanding of the specification, not to be construed as claim limitations. Further, to the extent that these terms are used herein, the applicant does not imply that all stated objectives are applicable to every claim. The claims are intended to be interpreted as broadly as reasonably possible, within the context of the present disclosure, but are not intended to claim the identical subject matter as any claim based on that application.

We claim:

1. A patient repositioning system comprising:

a mattress having a head end and a foot end and an upper surface;

a sheet residing on the upper surface;

a drive mechanism operatively coupled to the sheet and adapted to pull the sheet toward the head end, thereby to reposition a patient supported on the mattress;

a housing holding the drive mechanism; and the mattress further comprising a body portion and at least one side bolster operatively coupled along one longitudinal side of the body portion, thereby to widen the upper surface of the mattress so as to accommodate bariatric dimensions, wherein the mattress body portion comprises at least one row of one or more retainers substantially covered by the operatively coupled side bolster, and wherein the operatively coupled side bolster comprises voids located on a vertically oriented inner surface thereof which abuts against the adjacently located mattress body portion, the voids corresponding to a like number of retainers on the abutting surface of the mattress body portion, whereby the voids facilitate proper positioning and alignment of the side bolster.

2. The patient repositioning system of claim 1 and further comprising a user interface operatively coupled to the drive mechanism.

3. The patient repositioning system of claim 1 wherein the operatively coupled side bolster further comprises at least one row of one or more retainers adapted to retain a corresponding side edge of the sheet.

4. The patient repositioning system of claim 1 wherein the operatively coupled side bolster comprises a firmer head end section to limit the compressibility of the bolster and to facilitate guiding the sheet into the drive mechanism.

5. A patient repositioning system comprising:

a mattress having a head end and a foot end and an upper surface;

a sheet residing on the upper surface, the mattress and the sheet sized to accommodate a bariatric bed; and a drive mechanism operatively coupled to the sheet and adapted to pull the sheet toward the head end, thereby to reposition a patient supported on the mattress, the drive mechanism having a dimension less than the width of the mattress;

a housing holding the drive mechanism and also having a dimension less than the width of the mattress; and a pair of transition pieces located adjacent the head end of the mattress and on opposite sides of the housing, thereby to facilitate pulling the sheet into the housing during repositioning, wherein the transition pieces comprise a pair of wings adapted to be pulled outwardly from or pushed inwardly toward the mattress.

6. The patient repositioning system of claim 5 wherein the transition pieces comprise a pair of pivoting ledges which hold a pair of corresponding mattress sections.

7. A patient repositioning system comprising:

a mattress having a head end and a foot end and an upper surface;

a sheet residing on the upper surface;

a drive mechanism operatively coupled to the sheet and adapted to pull the sheet toward the head end, thereby to reposition a patient supported on the mattress; and a housing holding the drive mechanism, wherein the housing has a widthwise dimension that is substantially the same as the width of a bariatric bed frame so as to accommodate patient repositioning relative to the bariatric bed frame when the housing is held in a repositioning position with respect thereto, the housing being rotatable with respect to a vertical axis from the repositioning position so as to enable passage through a conventional sized doorway.

8. The patient repositioning system of claim 7 wherein the widthwise dimension of the housing is greater than 36 inches.

9. A patient repositioning system for a bariatric bed comprising:

a mattress having a head end and a foot end and an upper surface;

a sheet residing on the surface, the mattress and the sheet sized to accommodate a bariatric bed;

a drive mechanism operatively coupled to the sheet and adapted to pull the sheet toward the head end, thereby to reposition a patient supported on the mattress toward the head end; and a housing holding the drive mechanism, wherein the housing expands in dimension to a bariatric dimension so as to accommodate the widthwise dimension of the bariatric mattress and sheet, for bariatric repositioning of the patient, and the housing also contracts to a dimension that is less than the bariatric dimension so as to accommodate passage through a standard size doorway.

10. The patient repositioning system of claim 9 wherein the housing includes at least one vertical sidewall that slides outwardly to expand/contract the housing when deployed/moved.

11. The patient repositioning system of claim 9 wherein the housing affirmatively locks in place when expanded to the bariatric dimension.

12. The patient repositioning system of claim 9 wherein the housing comprises slideable sections with overlapping surfaces that permit the housing to be telescopically expanded and contracted in a manner which contains the internal volume of the housing.

13. The patient repositioning system of claim 9 wherein the drive mechanism comprises slideable pieces with overlapping surfaces that permit the drive mechanism to be telescopically expanded and contracted.

14. The patient repositioning system of claim 13 wherein the slideable pieces positively lock in place when deployed.

15. The patient repositioning system of claim 9 and further comprising a bed, and a mechanism to widen and narrow an upper surface of the bed so as to accommodate a bariatric dimension.

16. The patient repositioning system of claim 15 wherein the mechanism also expands and contracts the widthwise dimension of the housing.

17. The patient repositioning system of claim 16 wherein the mechanism also expands and contracts the widthwise dimension of the drive mechanism.

* * * * *